US007469516B2

(12) United States Patent
Smith

(10) Patent No.: US 7,469,516 B2
(45) Date of Patent: Dec. 30, 2008

(54) MODULAR STAIRCASE CONSTRUCTION

(76) Inventor: Lynn H. Smith, 805 Paxton Rd., Gunter, TX (US) 75058

( * ) Notice: Subject to any disclaimer, the term of this patent is extended or adjusted under 35 U.S.C. 154(b) by 785 days.

(21) Appl. No.: 11/039,730

(22) Filed: Jan. 19, 2005

(65) Prior Publication Data

US 2006/0156649 A1 Jul. 20, 2006

(51) Int. Cl.
*E04F 11/00* (2006.01)
*E04F 19/10* (2006.01)
*E04F 21/00* (2006.01)

(52) U.S. Cl. ..... 52/741.2; 52/182; 52/187; 52/188; 52/191

(58) Field of Classification Search ..... 52/741.2, 52/182–191
See application file for complete search history.

(56) References Cited

U.S. PATENT DOCUMENTS 2,171,951 A * 9/1939 Rosenberger ..... 52/189
3,099,336 A * 7/1963 Hawkins ..... 52/182
3,196,997 A * 7/1965 Hager ..... 52/182
3,788,018 A * 1/1974 Simmons et al. ..... 52/185
3,859,771 A * 1/1975 Simmons et al. ..... 52/741.2
3,902,948 A * 9/1975 Morros ..... 156/222
4,583,335 A * 4/1986 Morellini ..... 52/182
4,722,164 A * 2/1988 Scholler ..... 52/741.2
4,850,164 A * 7/1989 McLeod ..... 52/182
4,869,035 A * 9/1989 Scholler ..... 52/187
4,953,602 A 9/1990 Smith
5,163,491 A * 11/1992 Smith ..... 144/353
5,205,093 A * 4/1993 Schuette ..... 52/182
5,261,201 A 11/1993 Smith
5,347,774 A * 9/1994 Smith ..... 52/182
5,502,933 A * 4/1996 Skillern ..... 52/182
5,551,495 A 9/1996 Smith
5,613,341 A * 3/1997 Skillern ..... 52/741.2
5,636,483 A * 6/1997 Wille ..... 52/188
5,720,136 A * 2/1998 Turner ..... 52/182
5,737,884 A * 4/1998 Schrom ..... 52/187
5,806,254 A * 9/1998 Bennett ..... 52/182
5,899,032 A * 5/1999 Buzby ..... 52/182
6,088,977 A * 7/2000 Lawrence ..... 52/182
6,112,480 A * 9/2000 Turner ..... 52/182
6,115,975 A * 9/2000 Abdollahi ..... 52/179
6,230,454 B1 * 5/2001 Meagher ..... 52/182
6,968,655 B2 * 11/2005 Lawrence ..... 52/191
7,047,698 B2 * 5/2006 Torch ..... 52/182

* cited by examiner

*Primary Examiner*—Richard E Chilcot, Jr.
*Assistant Examiner*—Andrew J Triggs
(74) *Attorney, Agent, or Firm*—Haynes and Boone, LLP

(57) ABSTRACT

A staircase structure, representatively at least partially curved, is constructed from longitudinal modules each having tread, riser and stringer portions. In one embodiment of the construction technique, stringer portions of the modules are longitudinally telescoped with one another and then intersecured so that the interfitted modules form successive longitudinal portions of the assembled staircase structure. In another embodiment of the construction technique, stringer portions of the modules are vertically stacked and then intersecured. Illustratively, the riser and stringer portions of each module are of a laminated wooden construction shaped in situ on the underside of module tread portion by a CNC milling machine.

29 Claims, 19 Drawing Sheets

MODULAR STAIRCASE CONSTRUCTION

BACKGROUND OF THE INVENTION

The present invention generally relates to the fabrication of staircases, particularly to staircases which are at least partially curved, and, in a representatively illustrated embodiment thereof, more particularly relates to improved construction techniques for such staircases.

Conventional factory fabrication of a curved staircase, for subsequent shipment to an installation site, is typically initiated by the laborious construction of a horizontally spaced pair of temporary vertical support walls with curvatures conforming to the curved paths which the opposite sides of the completed staircase will ultimately assume. The opposite sides of the staircase, in the form of elongated "stringer" structures, are then secured along their lengths to these support walls in the predetermined curving and rising paths of the staircase sides.

The staircase stringers are typically of a laminated wooden construction formed by elongated thin wooden laminae which are glued together in the usual horizontally side-to-side orientation. In forming each stringer it is customary to secure one or more initial layers thereto to its associated support wall and then secured and glue successive layers to the previously secured layer(s) until the stringer is laterally built up to its necessary thickness.

After the stringers have been formed in place in this manner on the support walls, careful measurements are made and riser/tread notches are hand-cut into upper side edges of the stringers for later receipt of the riser and tread portions of the individual step structures which will extend across the stringers. It is necessary that these riser/tread notches be cut into the stringers after the stringers are laterally built up to their full widths. It is exceedingly difficult, if not impossible, to pre-cut the riser/tread notches in the individual stringer laminae and then have them properly align with their adjacent laminae notches in the subsequently built-up stringers.

Next, careful measurements are taken on and between the completed stringers for the purpose of fabricating the individual riser and tread member portions of the staircase. When these staircase components are subsequently fabricated, they are operatively positioned on and secured to the temporary wall-supported stringers. Finally, the partially completed staircase is carefully removed from the temporary support walls for pre-finishing and shipment to the job side where attachment of the remaining staircase components (such as the hand rail and balusters) and installation of the completed staircase carried out.

Even from the brief description above, it can readily be seen that the conventional fabrication of a curved staircase is fraught with tedium, complexity, expense and a variety of potential constructional inaccuracies. For example, great care and considerable amount of construction are typically required to accurately erect the temporary support walls onto which the stringer and step portions of the staircase are initially built. Additionally, a similar amount of care is required to correctly lay out the curved, rising stringer paths on these walls so that the completed stringers are accurately configured with respect to both their rises and their curvatures. Further, because the built-up stringers ultimately determined the precise shapes and dimensions of the risers and treads, a great deal of hand forming, matching and fitting is required to fabricate these staircase elements and operatively secure them to the stringers.

After all of this is done, of course, the task still remains to remove the completed staircase portion from its associated support walls and ready the finished staircase structure for shipment. Because a curved staircase of this type is often a one-of-a kind custom design, the laboriously constructed support walls are, in most instances, simply torn apart since that layout is of no further use except in constructing that particular staircase or one essentially identical thereto.

Additionally, because the stringer structures must be bent around the temporary support walls (around either their inner or outer side surfaces) and firmly secured thereto, the outer side surfaces of the stringers, which would normally define the "finished" outer side surfaces of the completed staircase, are frequently marred or otherwise damaged. This typically necessitates the securement to the stringers of a sheet of finishing veneer material after their removal from the temporary support walls, thereby further adding to the overall labor time and expenses associated with the staircase.

The complexity and precision entailed in this conventional staircase fabrication technique renders it, as a general proposition, unsuitable for on-site use by a general construction contractor. Accordingly, it is normally carried out only in a factory setting by skilled woodworking artisans.

Many of these problems, limitations and disadvantages were at least substantially reduced by the improved curved staircase manufacturing methods illustrated and described in the present applicant's U.S. Pat. Nos. 5,163,491 and 5,347,774. In a first staircase construction method disclosed in these patents, preformed step structures have treads with curved slots formed in the underside of their ends which define a path for insertion of top edge segments of thin starter strips. The slots are collectively configured to laterally deflect the inserted starter strips in a manner longitudinally conforming them to at least partially curved paths of the overall stringer structures in the completed staircase. The stringers are then laterally built up and completed by securing reinforcing structures to the side surfaces of the laterally deflected strips.

A second staircase construction method disclosed in these patents used preformed cooperating treads and risers themselves as a form which defines an at least partially curved path for the stringers. Simple temporary supports both position the cooperating treads and risers and provide a solid support for laying up strips from the inside out to form stringers to support the stair and back finishing strips along curved paths defined by the cooperating treads and risers wherein the finishing strips have edges configured to interengage the outer ends of the cooperating treads in a rigid assembly and for smooth sides of the staircase.

While these staircase construction methods provide needed improvements to the above-described conventional method of utilizing complex temporary wall structures to form an at least partially curved staircase structure which is shipped to the job side in an assembled state, they still present various problems, limitations and disadvantages. For example, a considerable amount of skill and time is required to accurately assemble the staircase at the job site and to properly fabricate the laminated stringer portion, layer-by-layer, along the entire length of the staircase. Additionally, since the joints between the adjacent pairs of stringer laminae are essentially vertical in the assembled staircase, vertical loads on the staircase undesirably impose vertical shear loading on the stringer structures. This can cause unsightly buckling and separation of the stringer laminae which may be quite difficult to repair.

From the foregoing it can be seen that it would be desirable to provide further improved staircase manufacturing methods and resulting staircase apparatus for shipment to a job site for final fabrication and installation. It is to this goal that the present invention is primarily directed.

SUMMARY OF THE INVENTION

In carrying out principles of the present invention, in accordance with representatively illustrated embodiments thereof, a specially designed method of constructing a staircase structure is provided, together with the uniquely configured staircase structure resulting from the utilization of such method, the staircase structure representatively, but not necessarily, having an at least partially curved configuration.

In carrying out the method a series of longitudinal staircase modules is provided, with each module having a tread portion, a riser portion extending substantially perpendicularly thereto, and a longitudinally outwardly projecting stringer portion. The modules are positioned in a longitudinally serial array in which the stringer portion of each module longitudinally overlaps the stringer portion of each longitudinally adjacent module, and the modules in each longitudinally adjacent pair thereof are intersecured.

In one invention embodiment the positioning step is performed in a manner such that the stringer portion of each module is in a longitudinally telescoped, interfitted relationship with the stringer portion of each longitudinally adjacent module, and the intersecuring step is performed by securing each stringer portion to the stringer portion with which it is longitudinally telescoped. In another invention embodiment the positioning step is performed in a manner such that the stringer portion of each module overlies the stringer portion of the downwardly adjacent module without being in a telescoped relationship therewith.

According to one aspect of the invention, the positioning step is performed in a manner such that, with the exception of the lowermost module, the stringer portion of each module underlies and upwardly abuts the tread portion of the downwardly adjacent module to thereby provide cantilevered support for each module from an adjacent module.

According to another aspect of the invention, in the completed staircase structure the riser and stringer portions thereof are of laminated constructions in which their laminae are stacked in a direction transverse to the top side surfaces of the tread portions of the staircase structure.

In addition to providing a unique method of constructing a staircase structure by interconnecting and intersecuring prefabricated longitudinal module portions thereof, and the resulting specially configured staircase structure, the present invention also provides a novel method of constructing each longitudinal staircase module.

This method, preferably performed using a CNC milling machine, is carried out for each module, which is preferably of an all wooden construction, by progressively forming laminated riser and stringer structures on the underside of the tread portion of the module. Each of the riser and stringer laminae is formed from an oversize blank which is secured to and milled in situ on the tread. Preferably, opposite end portions of the riser laminae are interdigitated with front end portions of the stringer laminae in a manner such that, in alternating layers of the laminated riser and stringer structures, convex opposite end portions of the riser laminae complementarily engage concave end portions of stringer laminae, and concave opposite end portions of a riser lamina complementarily engage convex end portions of stringer laminae.

While each module is representatively of an all wooden construction, other materials could be used to form the modules, if desired, without departing from principles of the present invention. Additionally, the riser and stringer portions of the modules could be of non-laminated constructions, and could be formed in a manner other than milling, without departing from principles of the present invention.

DETAILED DESCRIPTION

Figure 1:
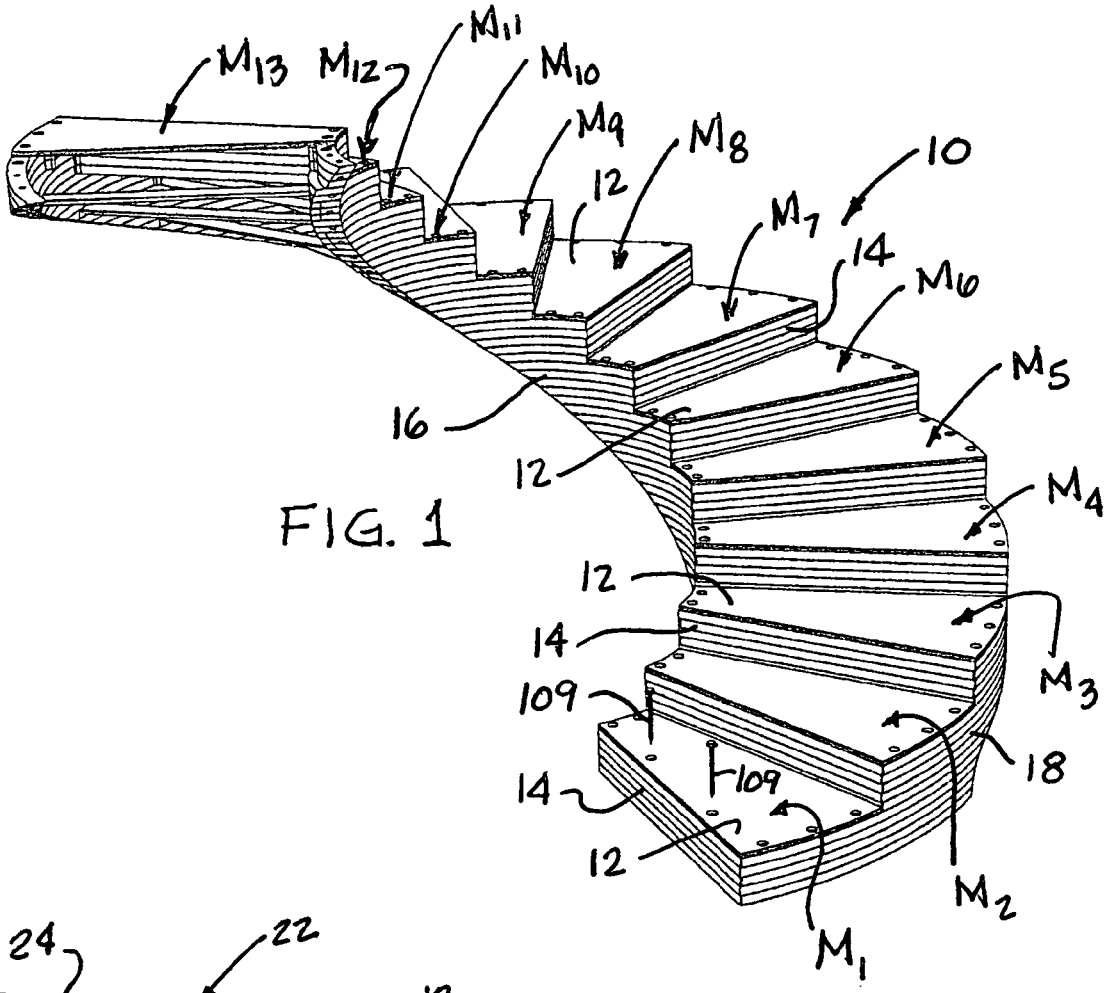
FIG. 1 is a perspective view of an assembled curved staircase structure embodying principles of the present invention.

Perspectively illustrated in FIG. 1 is a specially designed staircase structure 10 constructed by a method embodying principles of the present invention and defining a longitudinal portion of an overall staircase. Although the staircase structure 10 is representatively shown as having a laterally curved configuration along its vertically ascending length, the present invention is not limited to curved staircases and may be utilized to advantage in conjunction with entirely straight staircases, or staircases which are only partially curved, without departing from principles of the invention.

As used herein with respect to the staircase structure 10 or subsequently described modules thereof, "longitudinal" means extending parallel to the length of the finished staircase structure, "lateral" means extending from side to side along the finished staircase structure, and "top", "upper", "bottom", "lower", "front" and "rear" are used in reference to the finished staircase.

According to a key aspect of the present invention, the staircase structure 10 is of a unique modular construction, and is representatively defined by modules $M_1$-$M_{13}$, each of which defines a longitudinal segment of the completed staircase of which the staircase structure 10 is a part. Module $M_1$ is the lowermost module, and module $M_{13}$ is the uppermost module of the illustrated staircase structure 10, with the overall completed staircase being vertically dimensioned as required to extend through the necessary height. Each module M is representatively of a wooden construction, but could alternatively be formed from another material, if desired.

Along its length the staircase structure 10 has a series of horizontal, generally plate-shaped treads 12 interdigitated with vertical risers 14. Respectively extending along laterally opposite sides of the balance of the staircase structure 10 are elongated left and right side stringer assemblies 16 and 18.

Figure 2:
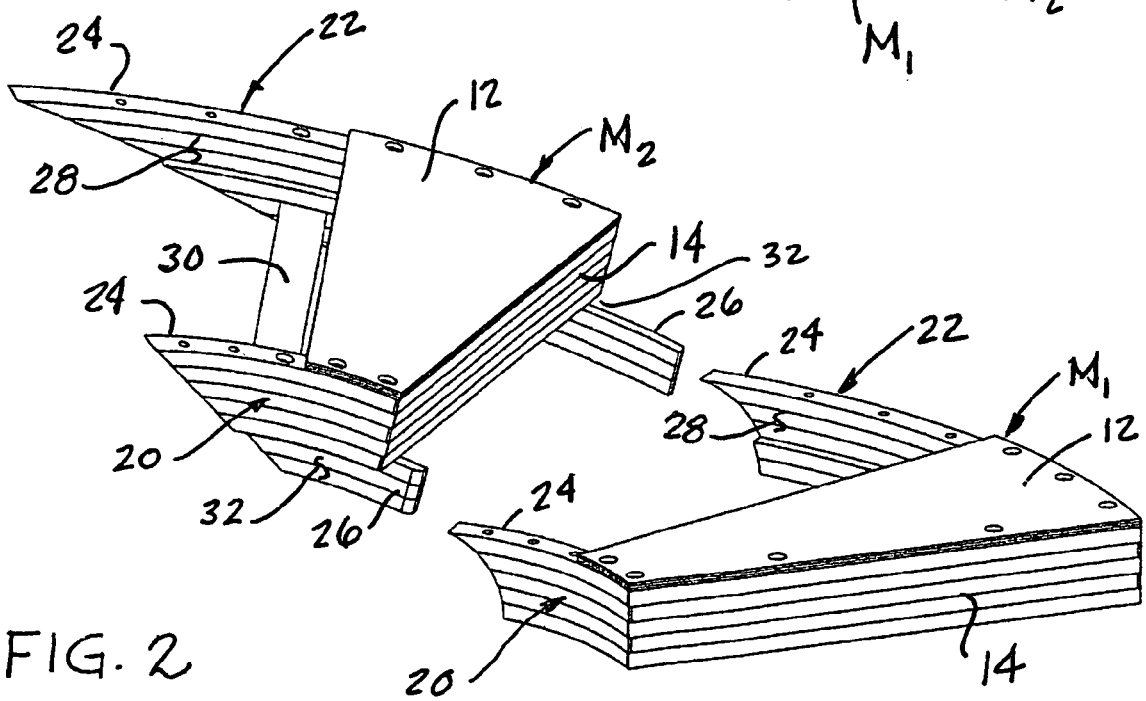
FIG. 2 is a top side perspective view of an unassembled pair of longitudinal module portions of the staircase.
Figure 3:
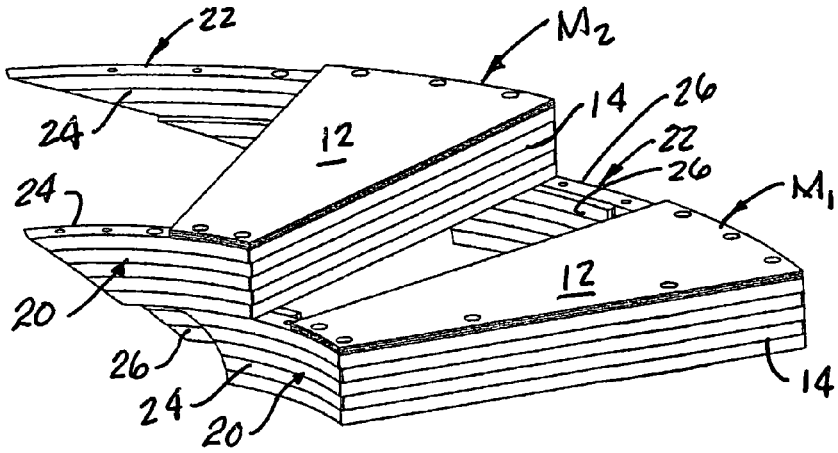
FIG. 3 is a top side perspective view of the FIG. 2 staircase modules being assembled.

With reference now to FIG. 2, which illustratively depicts the longitudinal staircase modules $M_1$ and $M_2$ in a separated state, each module $M_1$, $M_2$ has one of the treads 12 on its top side, one of the risers 14 depending from the front edge of the tread 12, and laterally opposite left and right elongated stringer portions 20 and 22. Each stringer portion 20, 22 has a representatively curved rear section 24 which projects rearwardly beyond its tread 12. The stringer portions 20, 22 of module $M_2$ also have representatively curved front sections 26 which project forwardly beyond its riser 14. Because the illustrated stringer portions 20, 22 are curved to the left, the outer or right stringer portion 22 is longer than its associated inner or right stringer portion 20. The stringer portions 20, 22 of the lowermost module $M_1$ do not have projecting front sections, and the uppermost module (not shown) of the completed staircase may have stringer portions shaped appropriately to the floor or landing connection associated with such uppermost module.

The rear stringer sections 24 have inner side surface recesses 28 extending longitudinally inwardly from their rear ends. Additionally, the parallel stringer portions 20, 22 of each module $M_1$, $M_2$ are joined by a cross-bracing member 30 (only visible on module $M_2$ in FIG. 2). The front stringer portion sections 26 of module $M_2$ are laterally inset from their associated rear stringer portion sections 24 in a manner forming in the left and right stringer portions 20, 22 of module $M_2$ exterior side surface recesses 32 extending longitudinally inwardly from the forwardly projecting portions of the front stringer portion sections 26.

Figure 4:
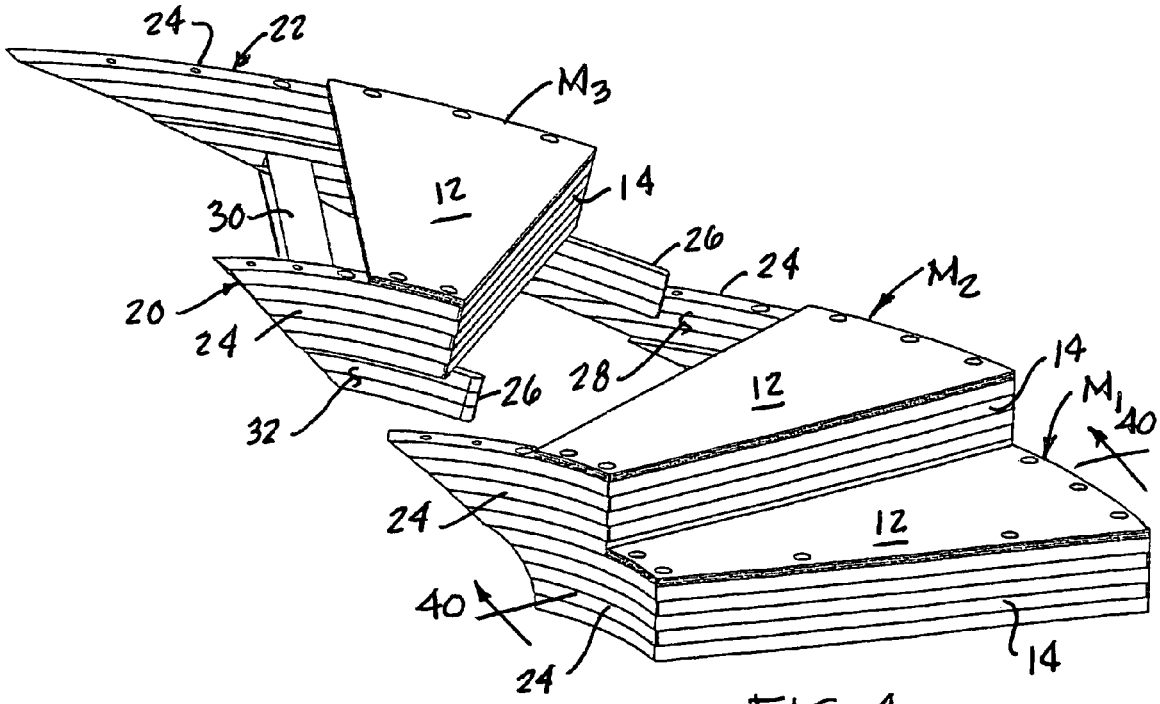
FIGS. 4-6 are top side perspective views sequentially illustrating the further modular assembly of the staircase.

In constructing the staircase structure 10 the stringer portions 20, 22 of the modules $M_1$, $M_2$ are longitudinally overlapped and laterally interfitted by simply inserting the front stringer sections 26 of module $M_2$ forwardly into the side surface recesses 28 of the rear stringer portions 20, 22 of module $M_1$, simultaneously inserting the rear stringer sections 24 of module $M_1$ rearwardly into the side surface recesses 32 of the stringer portions 20, 22 of module $M_2$, and sliding the modules $M_1$, $M_2$ toward one another until, as shown in FIG. 4, the tread 12 of the module $M_1$ is positioned against the riser 14 of module $M_2$. The interlocked stringer portions 20, 22 of the modules $M_1$, $M_2$ are appropriately anchored to one another using, for example, glue and screws.

Figure 40:
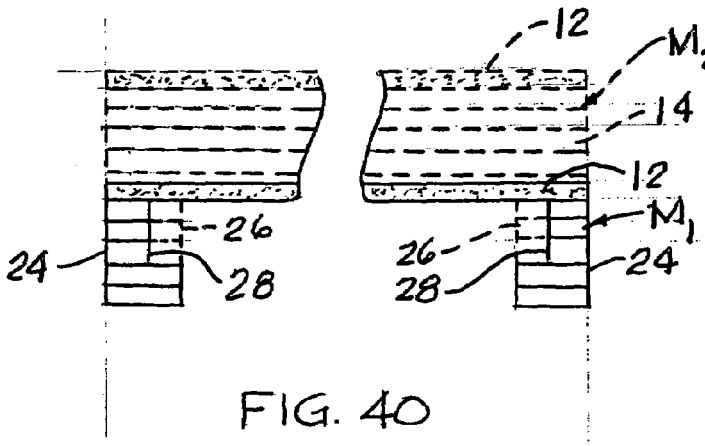
FIG. 40 is a schematic, laterally foreshortened cross-sectional view of two assembled staircase modules taken along line 40-40 Of FIG. 4.

FIG. 40 cross-sectionally illustrates the interlock between the assembled modules $M_1$, $M_2$ shown in FIG. 4. As illustrated in FIG. 40 (in which module $M_2$ is illustrated in phantom for illustrative clarity), the front stringer sections 26 of module $M_2$ received in the side surface recesses 28 of the rear stringer sections 24 of module $M_1$ underlie and upwardly abut the tread 12 of module $M_1$. This advantageously provides cantilever-type support for each module relative to the other module. Stated otherwise, with this interlock between the two modules $M_1$, $M_2$, each module is braced against forward or rearward pivoting relative to the other module.

Figure 6:
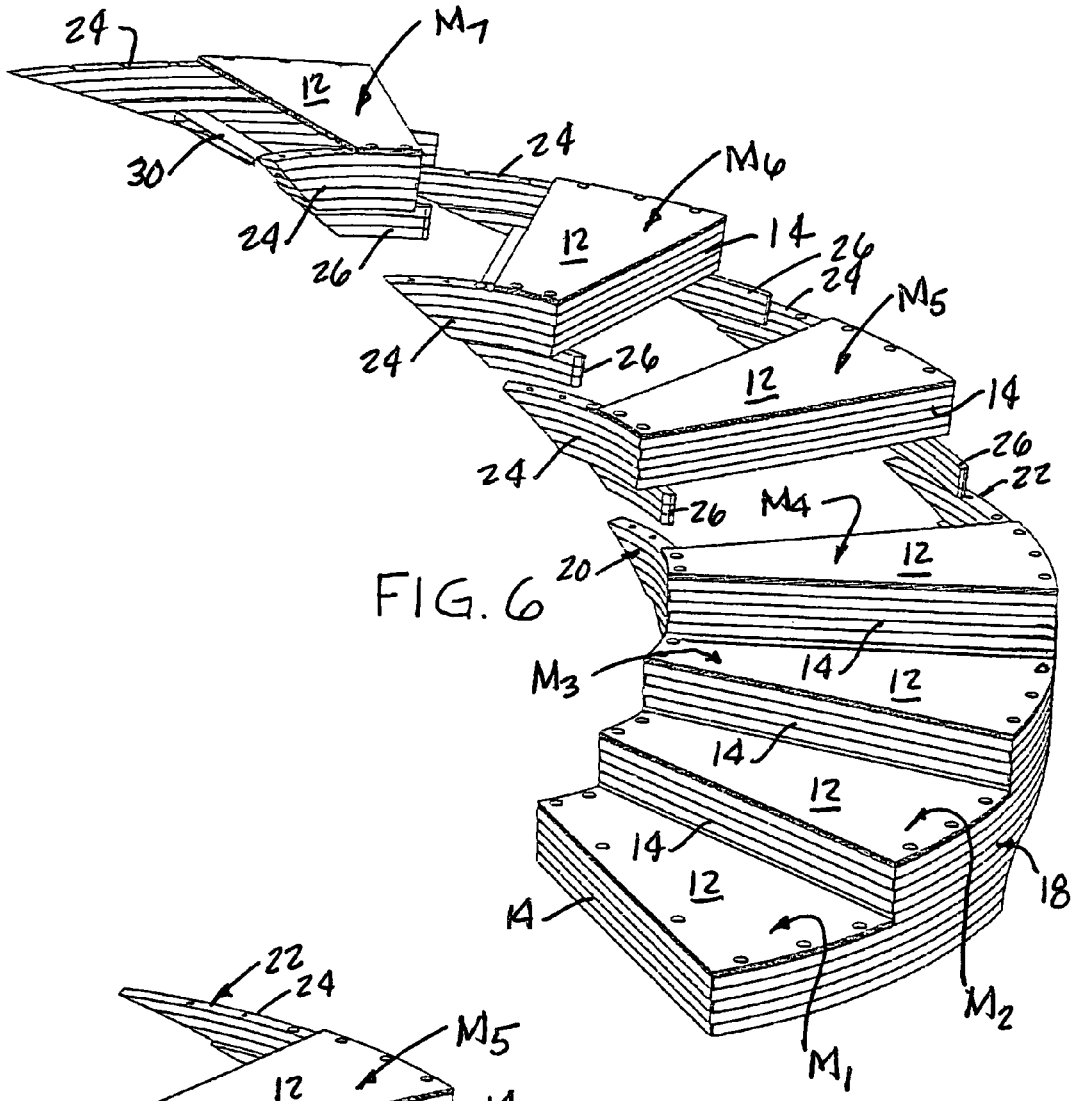
Figure 5:
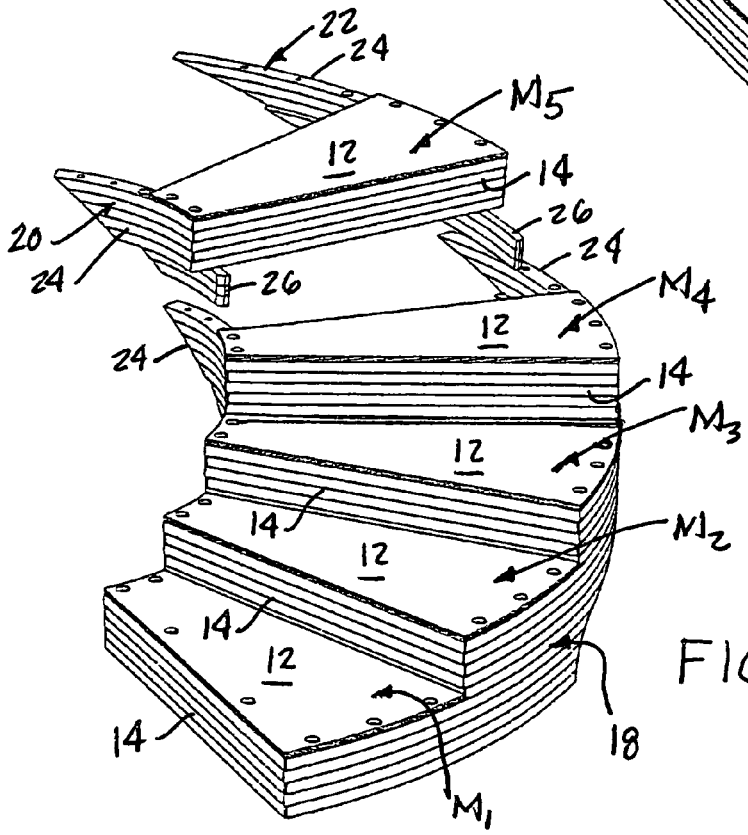

After the modules $M_1$, $M_2$ are operatively interlocked and intersecured in this manner, the upwardly successive modules $M_3$-$M_{13}$ may be sequentially secured to their downwardly adjacent modules as progressively illustrated in FIGS. 4-6 for modules $M_1$-$M_7$. While the modular assembly of the staircase structure 10 has been representatively depicted as being carried out from the "bottom up", it will be appreciated that such assembly could be carried out in other sequences if desired without departing from principles of the present invention.

Each of the modules $M_1$-$M_{13}$ in the staircase structure 10 is representatively of a laminated construction formed by a unique in situ fabrication method which will now be described in conjunction with FIGS. 7-37. For purposes of illustration, the fabrication of the previously described module $M_2$ will be described, with the fabrication of the other modules being carried out in a similar manner.

Figure 7:
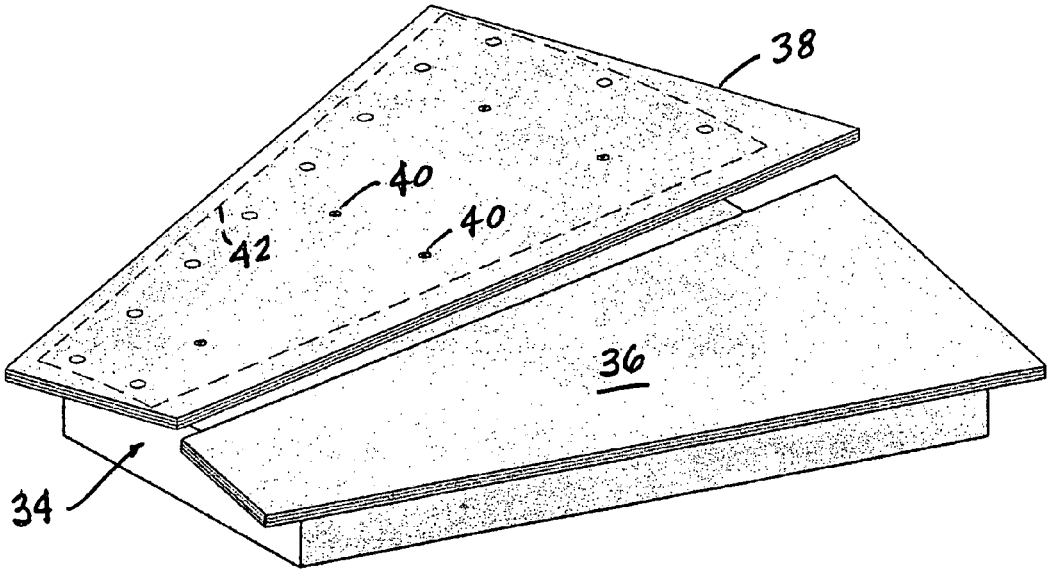
FIGS. 7-37 are bottom side perspective views sequentially illustrating the laminated construction technique representatively utilized to fabricate one of the longitudinal staircase modules.

Referring initially to FIG. 7, the in situ fabrication of the representative module $M_2$ is preferably carried out on a CNC milling machine having a base or platen 34 with an elevated horizontal rear platform portion 36. For illustrative simplicity, the platen 34 is shown in only FIGS. 7 and 17, but is used for each of the fabrication steps shown in the remainder of FIGS. 7-37.

Figure 8:
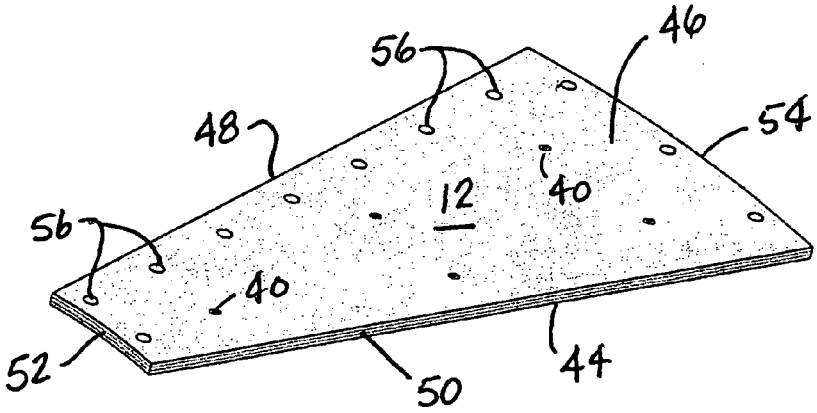

To initiate the in situ fabrication of the representative longitudinal staircase module $M_2$, a plywood tread blank 38 is suitably secured to the top side of the platen 34, forwardly of its elevated rear platform 36, by screws 40 (shown only in FIGS. 7 and 8). The dotted line area 42 shown in FIG. 7 on the tread blank 38 represents the trim line dimensions of the completed tread 12 which, as depicted in FIG. 8, is formed by milling the edges of the blank 38 to the trim line area 42. The completed tread 12, positioned in an upside down orientation on the platen 34, has top and bottom sides 44 and 46, front and rear edges 48 and 50, left and right side edges 52 and 54, and a spaced series of peripheral dowel holes 56 formed therethrough in conjunction with the tread milling operation.

Figure 9:
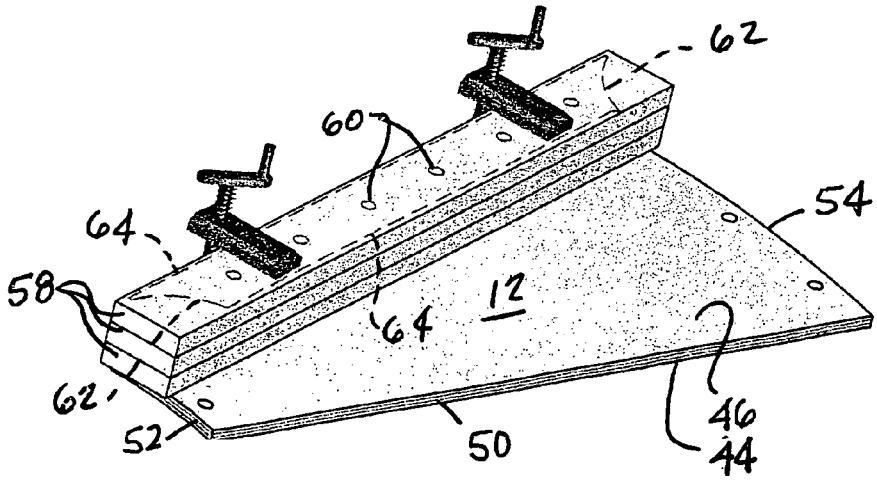
Figure 10:
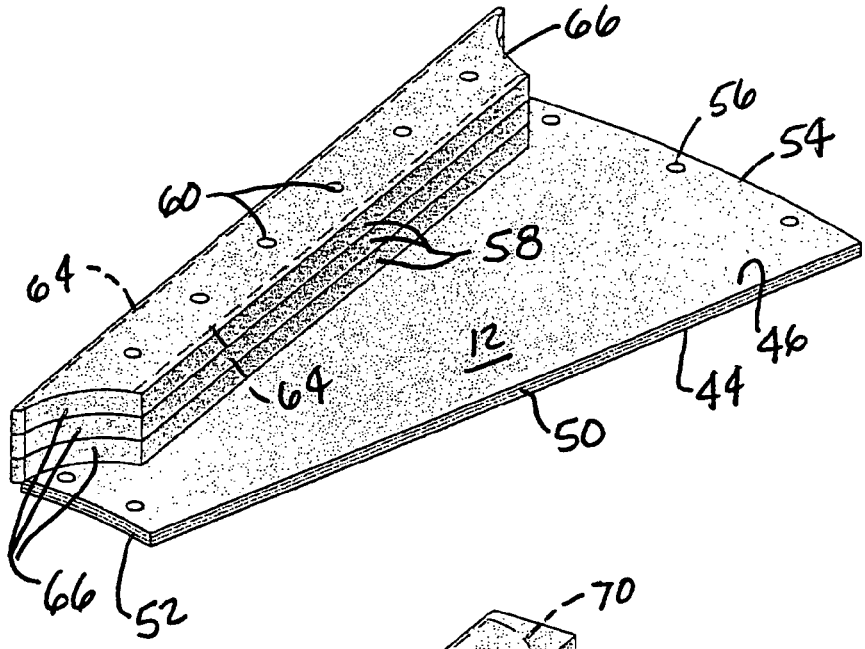
Figure 11:
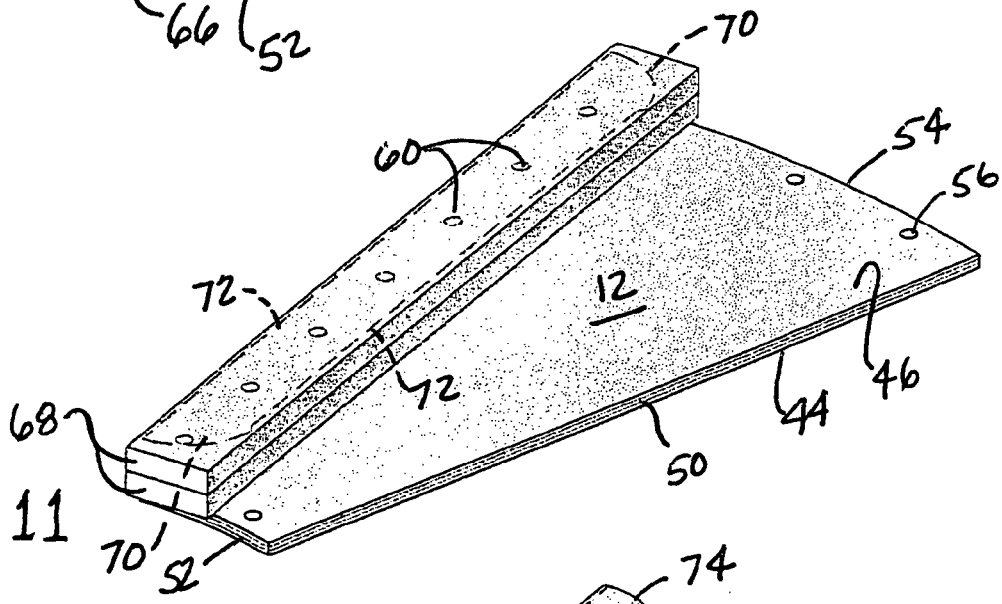
Figure 12:
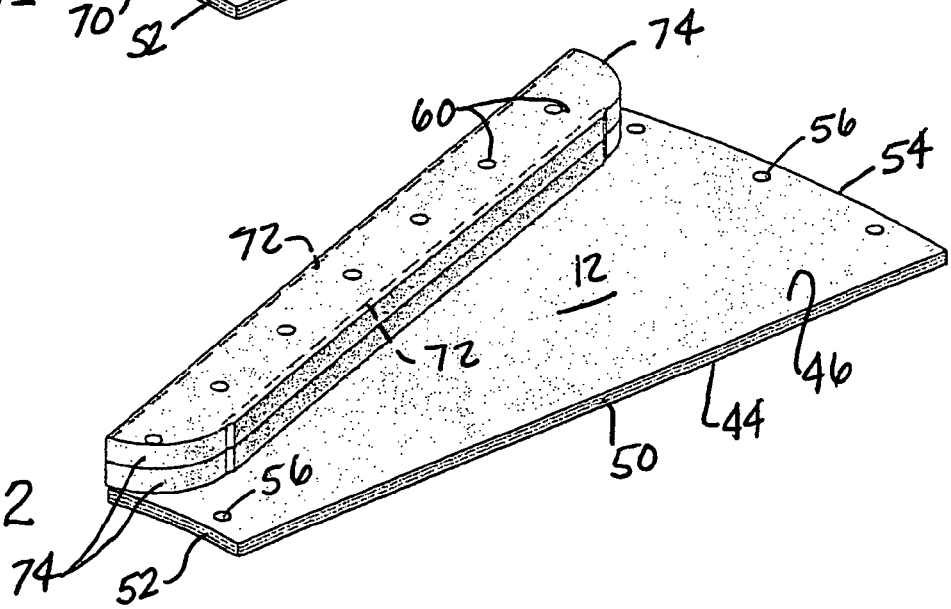

Next, as illustrated in FIG. 9, a stack of elongated rectangular solid wood riser laminae blanks 58 is clamped atop the platen 34, each lamina blank 58 in the stack having dowel holes 60 formed therethrough. Proper alignment of the stack relative to the tread 12 is achieved by extending temporary dowels (not shown) downwardly through the dowel holes 60 into underlying dowel holed 56 in the tread 12. Shown in dotted form on the stacked blanks 58 are end and side edge trim lines 62, 64. The ends of the stacked laminae blanks 58 are then milled to the end trim lines 62 (see FIG. 10), leaving concavely curved end surfaces 66 on the partially milled laminae blanks 58, and the laminae stack is removed and replaced with a second stack of elongated rectangular solid wood riser laminae blanks 68 clamped to the bottom side 46 of the tread 12 along the front side edge thereof, the blanks 68 having the indicated dowel holes 60 formed therein through which temporary dowels (not shown) are downwardly extended into underlying dowel holes 56 in the tread 12. As indicated in FIG. 11, the laminae blanks 68 have end and side edge trim lines 70, 72. The laminae blanks 68 are then milled to their end trim lines 70, to form convexly curved end surfaces 74 thereon (see FIG. 12), and unclamped and removed from the bottom side 46 of the tread 12.

Figure 13:
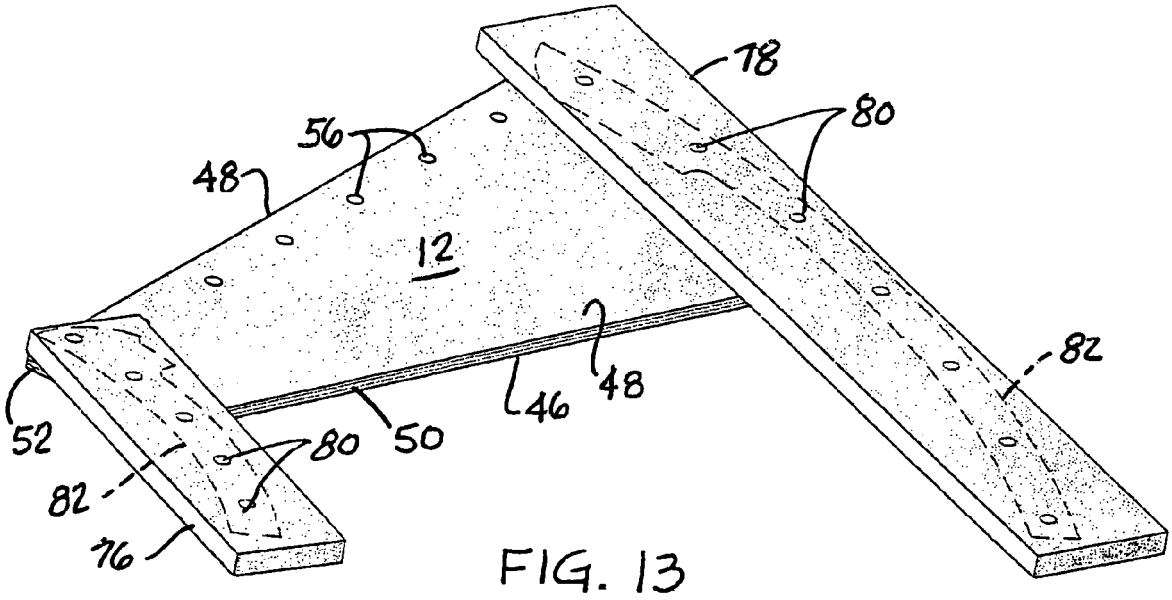
Figure 14:
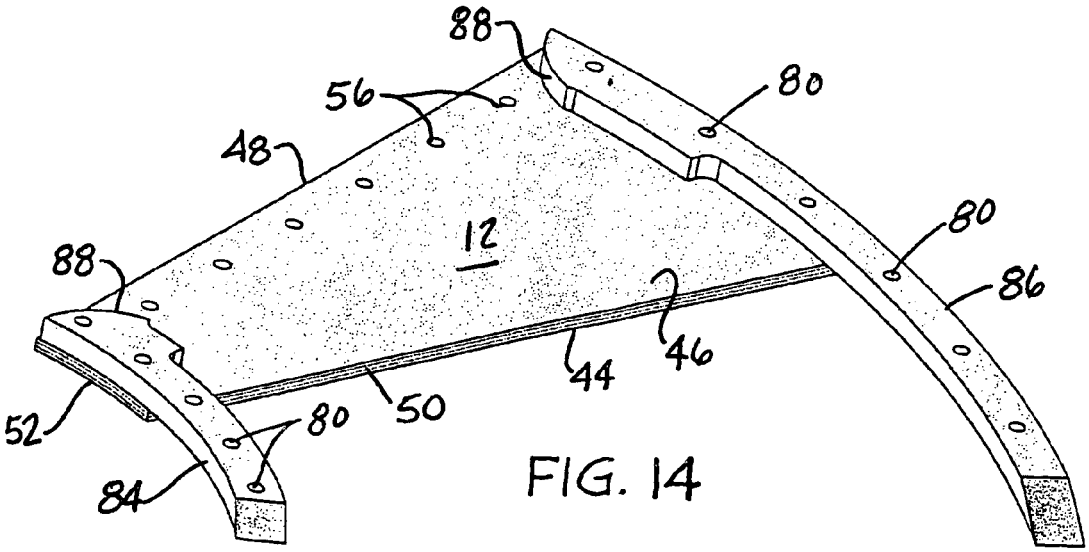

The next steps in the in situ fabrication of the representative module $M_2$ are the construction of the stringer portions 20 and 22, and the corresponding formation of the riser 14, such steps being sequentially illustrated in FIGS. 13-34. Turning first to FIG. 13, left and right elongated rectangular solid wood stringer laminae blanks 76, 78, having predrilled dowel holes 80 and a trim line pattern 82 as indicated, are respectively secured to the underside of the tread 12 over its left and right side edges 52, 54. This securement is representatively achieved by gluing the blanks 76, 78 to the tread 12 and extending dowels (not shown) downwardly through the dowel holes 80 into underlying dowel holes 56 in the underlying tread 12. The stringer blanks 76, 78 (as indicated in FIG. 14) are then milled to the trim patterns 82 to thereby respectively form elongated left and right stringer laminae 84 and 86 having convexly curved front end surfaces 88.

Figure 15:
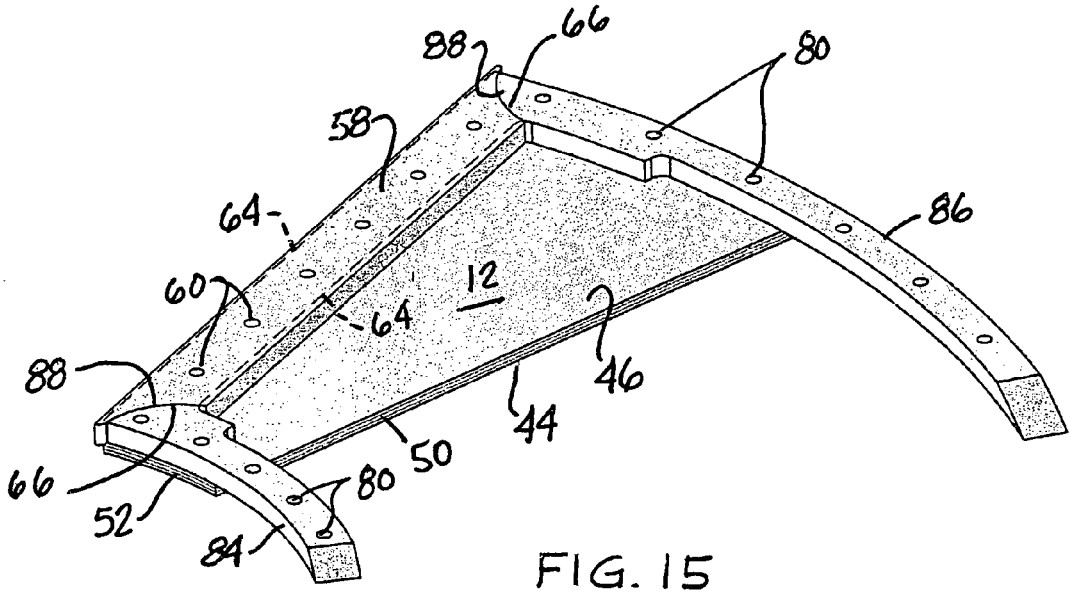
Figure 16:
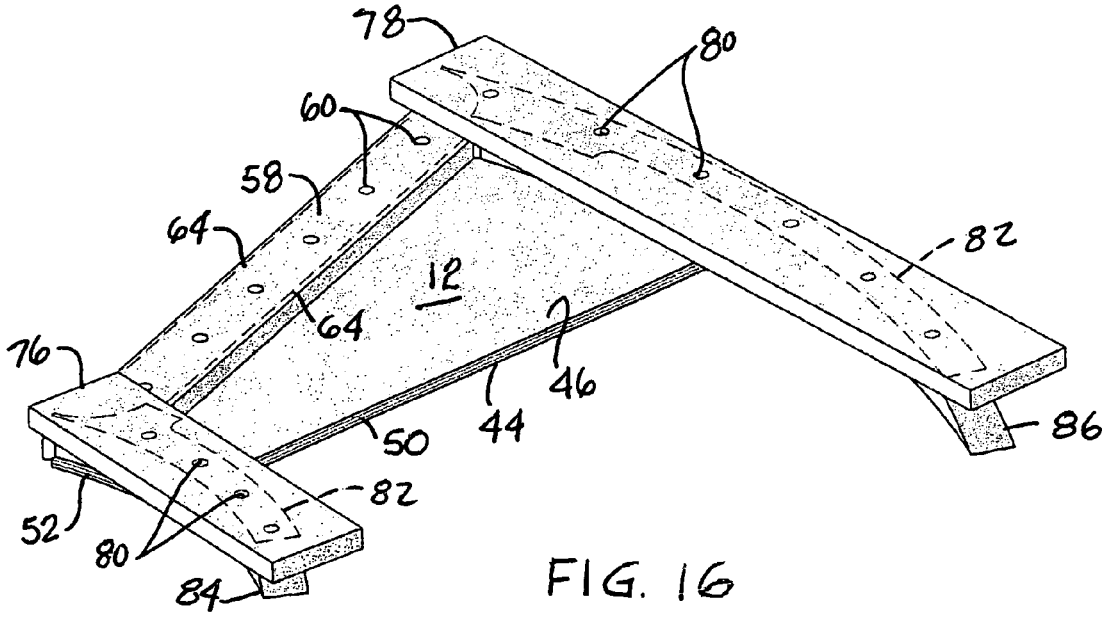

Next, as illustrated in FIG. 15, one of the partially milled riser laminae blanks 58 is inserted into the space between the convexly curved end surfaces 88 of the stringer laminae 84, 86 in a manner causing the concave end surfaces 66 of the inserted riser blank 58 to complementarily engage the convex stringer laminae end surfaces 88. This precisely aligns the dowel holes 60 of the inserted riser blank 58 with underlying dowel holes 56 in the tread 12, and the inserted riser blank 58 is secured to the underside of the riser 12 by glue and dowels (not shown) inserted downwardly through the dowel holes 58 into underlying riser dowel holes 56 (see FIG. 13).

Figure 17:
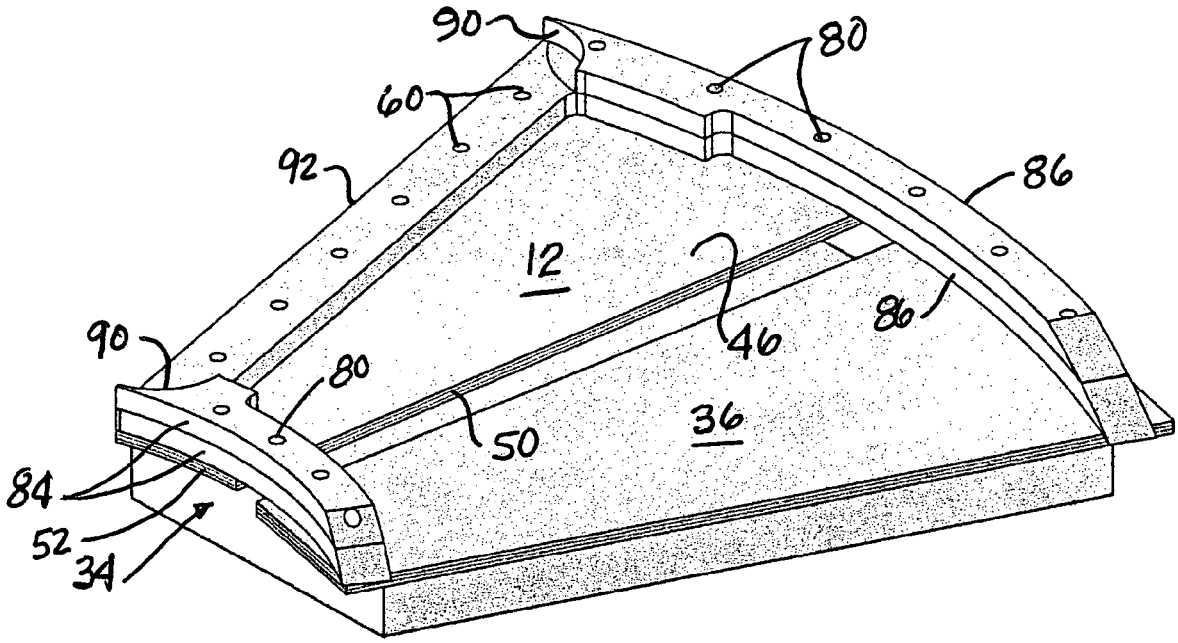
Figure 18:
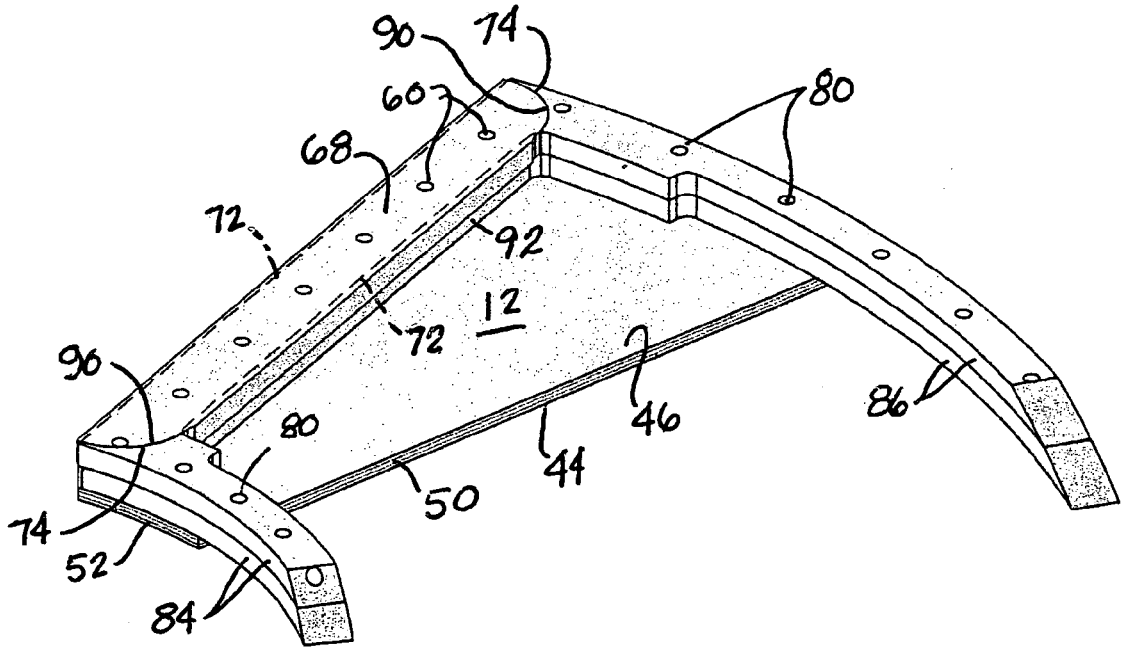

Additional left and right stringer laminae blanks 76, 78 (see FIG. 16) are then glued and doweled to the top side of the previously formed stringer laminae 84, 86 and milled to their trim profiles 82 to form additional stringer laminae 84, 86 having concave front end surfaces 90 thereon (see FIG. 17). In conjunction with this stringer milling operation, the previously secured riser blank 58 is milled to its side edge trim lines 64 to form the finished riser lamina 92 (see FIG. 17). Next, one of the partially milled riser laminae blanks 68 (see FIG. 18) is inserted between the lowermost stringer laminae 84, 86 in a manner such that the convex end surfaces 74 of the riser blank 68 complementarily engages the concave end surfaces 90 of the lowermost stringer laminae 84, 86. In this orientation the inserted riser blank 68 is glued and doweled to the bottom side of the previously formed riser lamina 92, and then milled to its side edge trim lines 72 to form the lowermost riser lamina 92 shown in FIG. 19.

Figure 19:
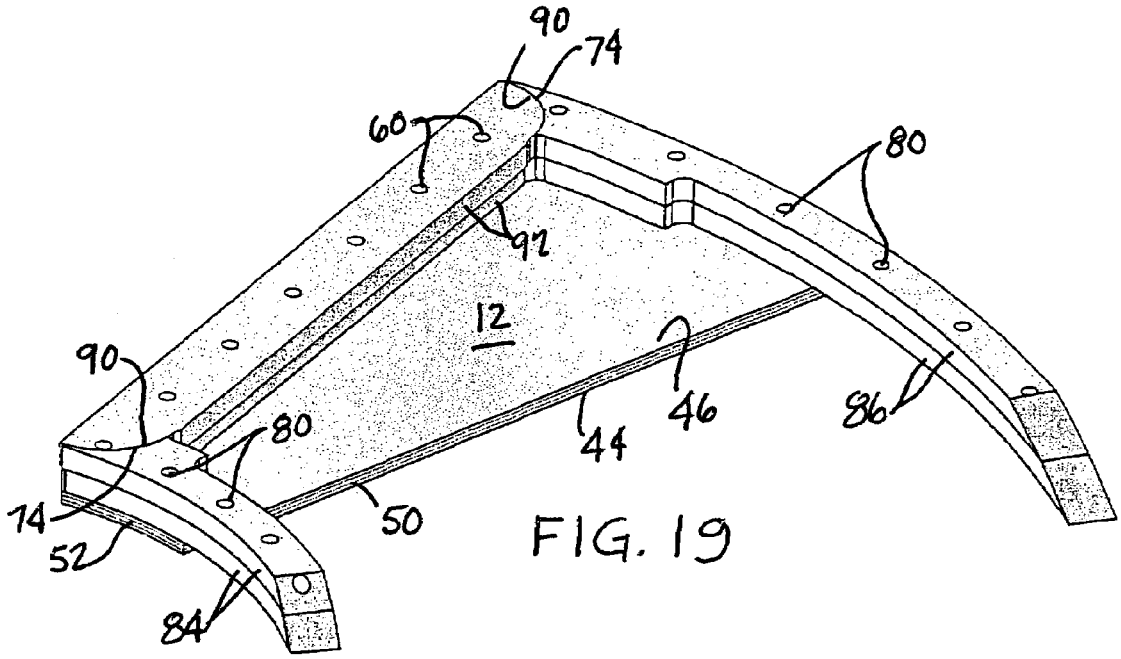
Figure 20:
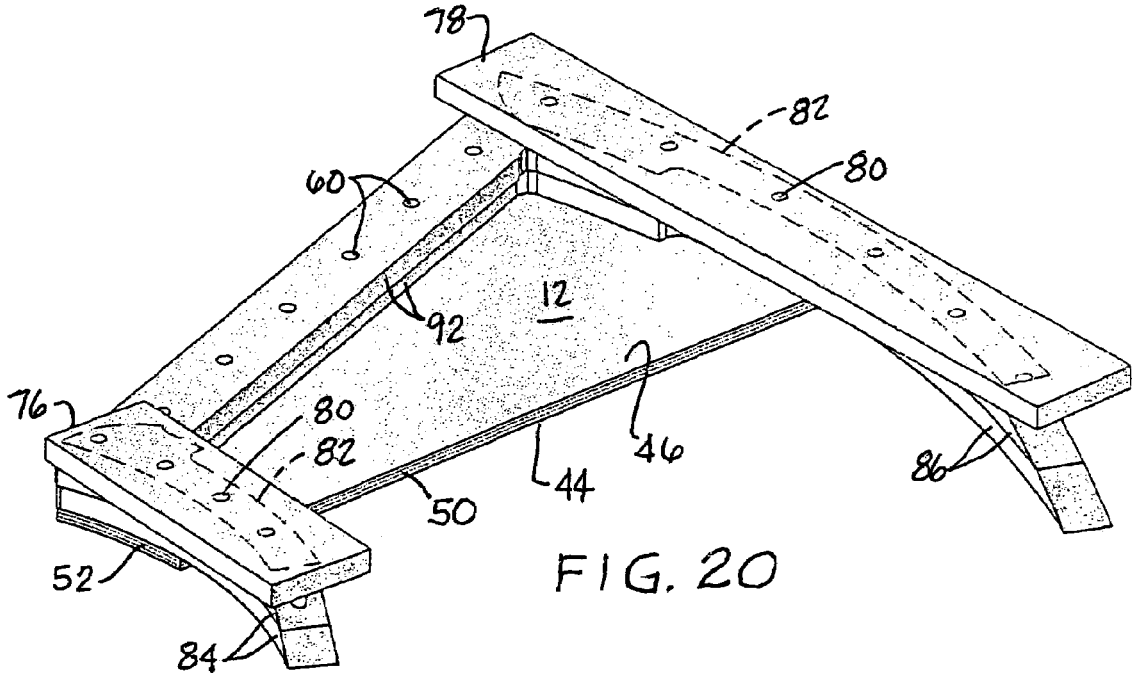
Figure 21:
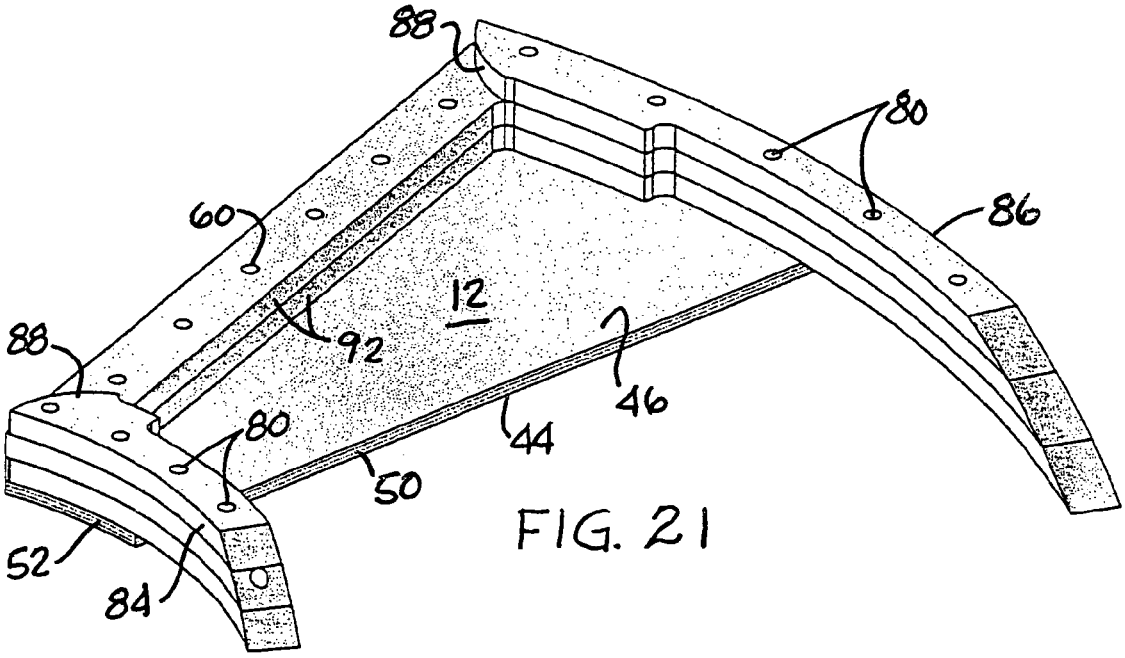
Figure 22:
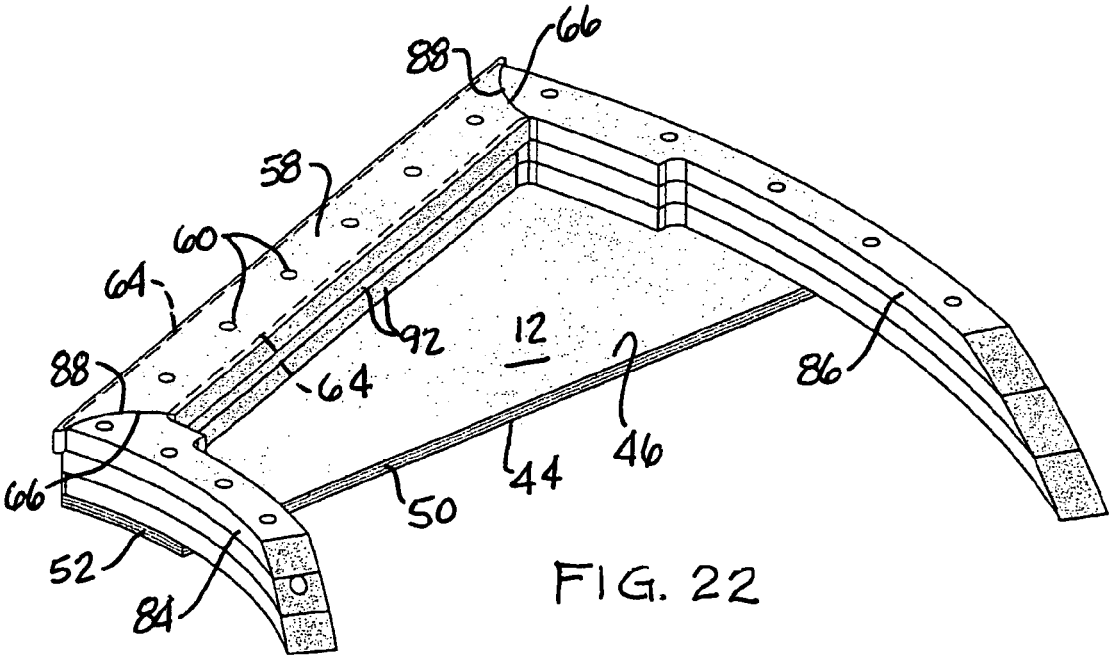
Figure 23:
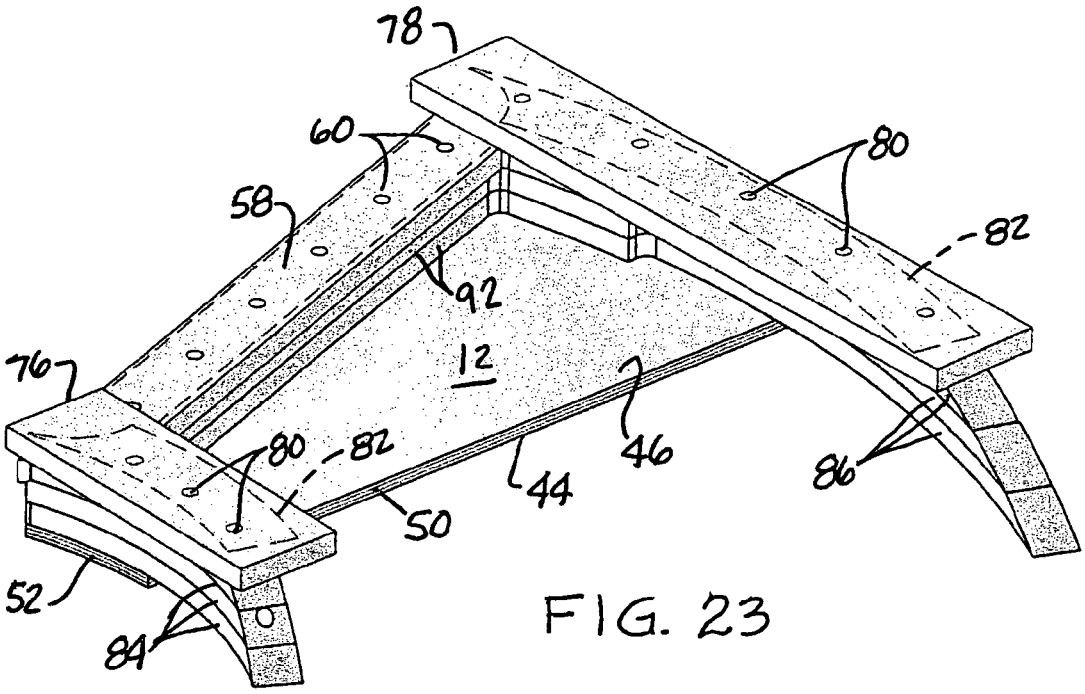
Figure 24:
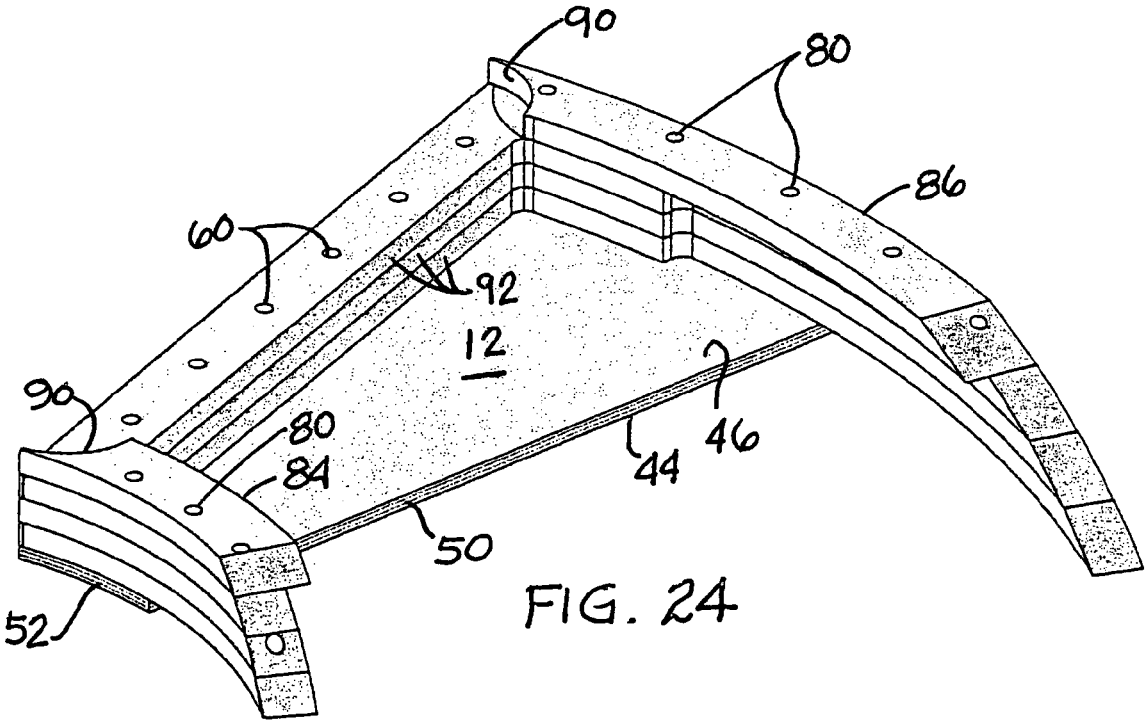
Figure 25:
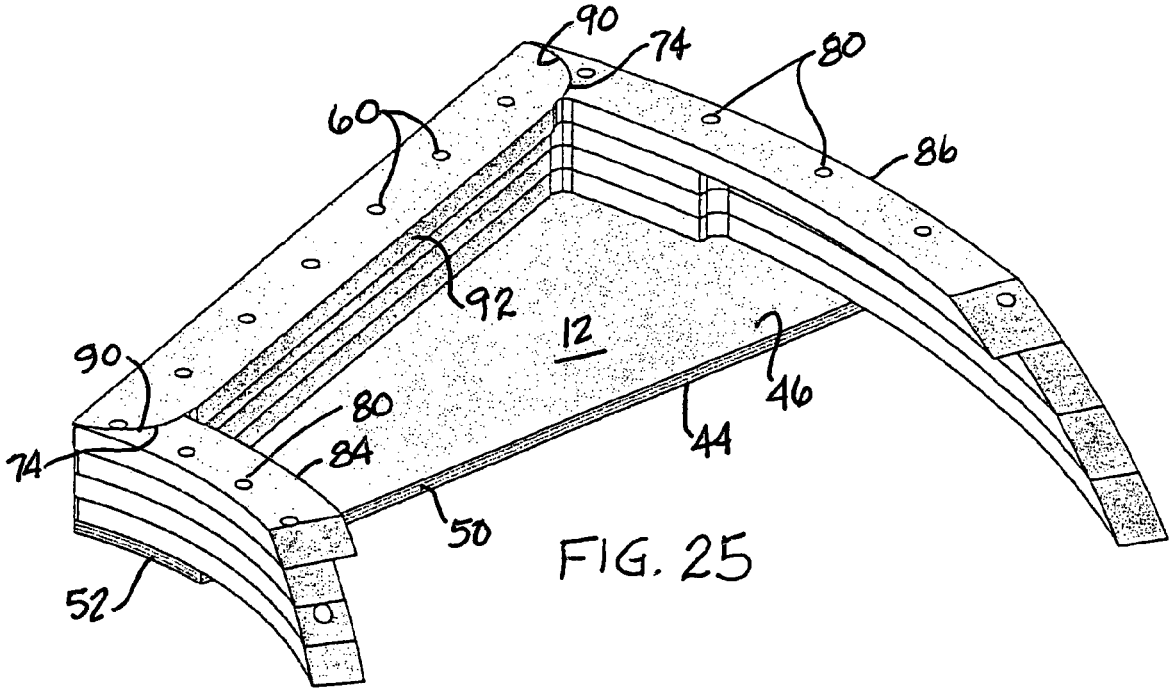
Figure 26:
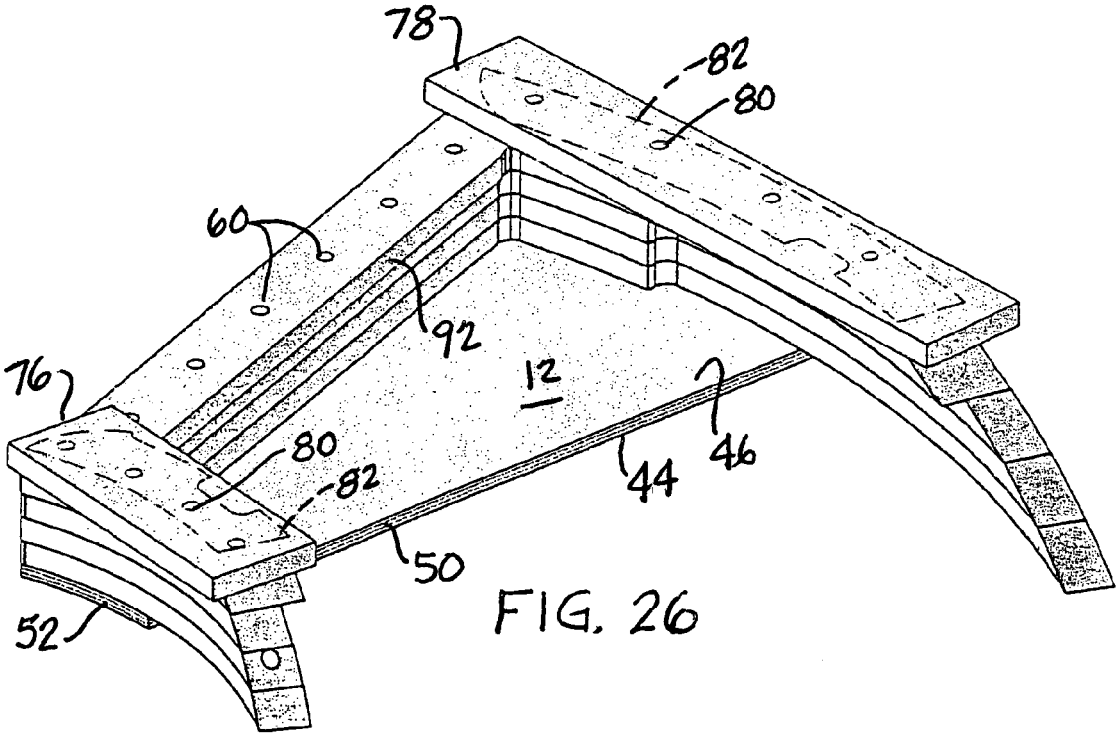
Figure 27:
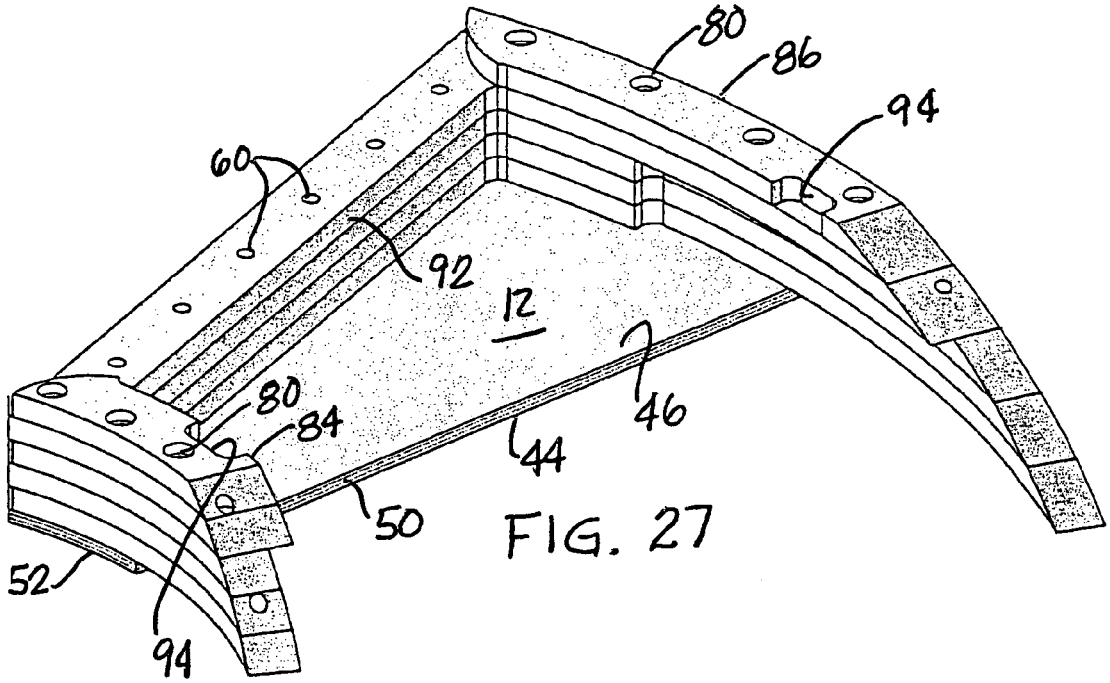

It should be noted that in the partially completed module shown in FIG. 19 front end portions of the stringer laminae 84, 86 are interdigitated with opposite left and right end portions of the riser laminae 92, with vertically alternating ones of the stringer laminae 84, 86 having convex and concave front end surfaces complementarily engaged by corresponding concave and convex left and right end surfaces of the riser laminae 92. This use of this convex/concave end surface mating between the riser and stringer laminae facilitates the accurate placement of the riser laminae relative to the stringer laminae during the lamination build-up process, and the interdigitating of riser and stringer laminae end portions substantially strengthens the joints between the stringer and riser portions of the completed module and reduces the amount of exposed end grain when using solid wood.

Figure 28:
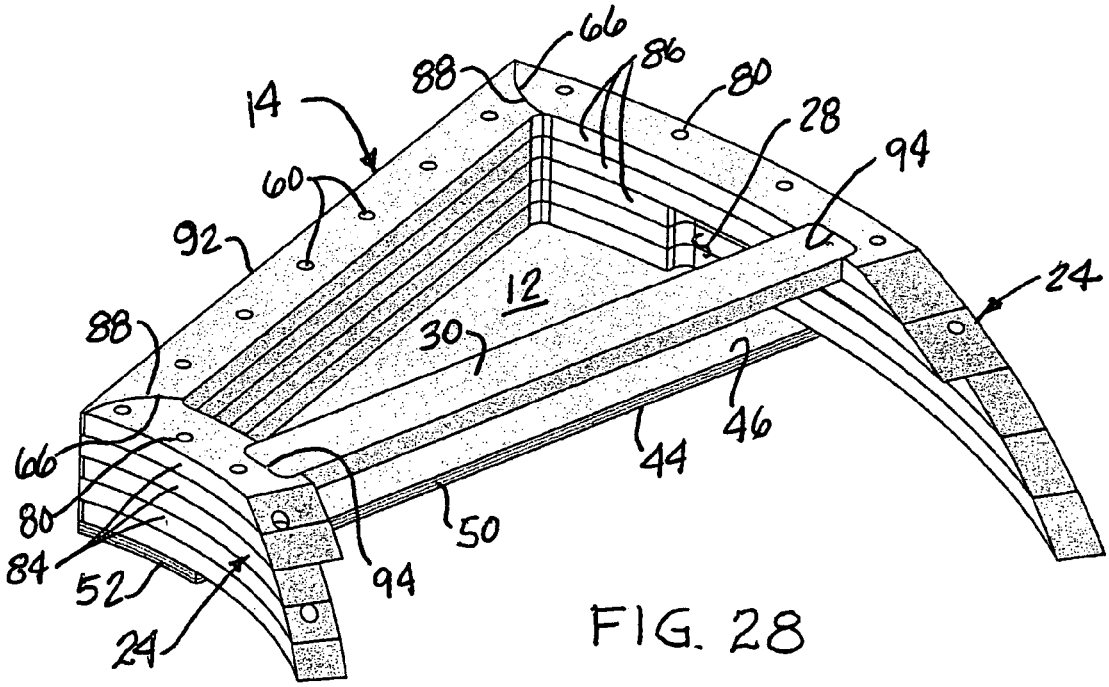

FIG. 19 shows the partially completed module $M_2$ with two completed stringer and riser layers thereon. Using the same in situ stacking and milling technique previously described in conjunction with FIGS. 16-19, FIGS. 20-28 sequentially illustrate the representative addition to the partially completed module of three more layers of stringer laminae 84, 86 and riser laminae 92 to complete the formation, as shown in FIG. 28, of the rear stringer sections 24. In the completed rear stringer sections 24, the uppermost three stringer laminae 84, 86 are notched along their inner side surfaces, and the two lowermost stringer laminae 84, 86 are made laterally wider than the notched stringer laminae portions to thereby form the previously described laterally inner side surface recesses 28 in the rear stringer sections 24. As additionally shown in FIG. 28, at this stage in the fabrication of the representative module $M_2$ opposite ends of the cross-bracing member 30 are suitably secured within inner side notches 94 formed in inner sides of the lowermost stringer laminae 84,86.

The next step in the overall in situ laminated construction process for the representative longitudinal staircase module $M_2$ is to form the previously described front stringer sections 26 (which project forwardly beyond the riser structure 14 as shown in FIG. 2) as sequentially depicted in FIGS. 29-34.

Figure 29:
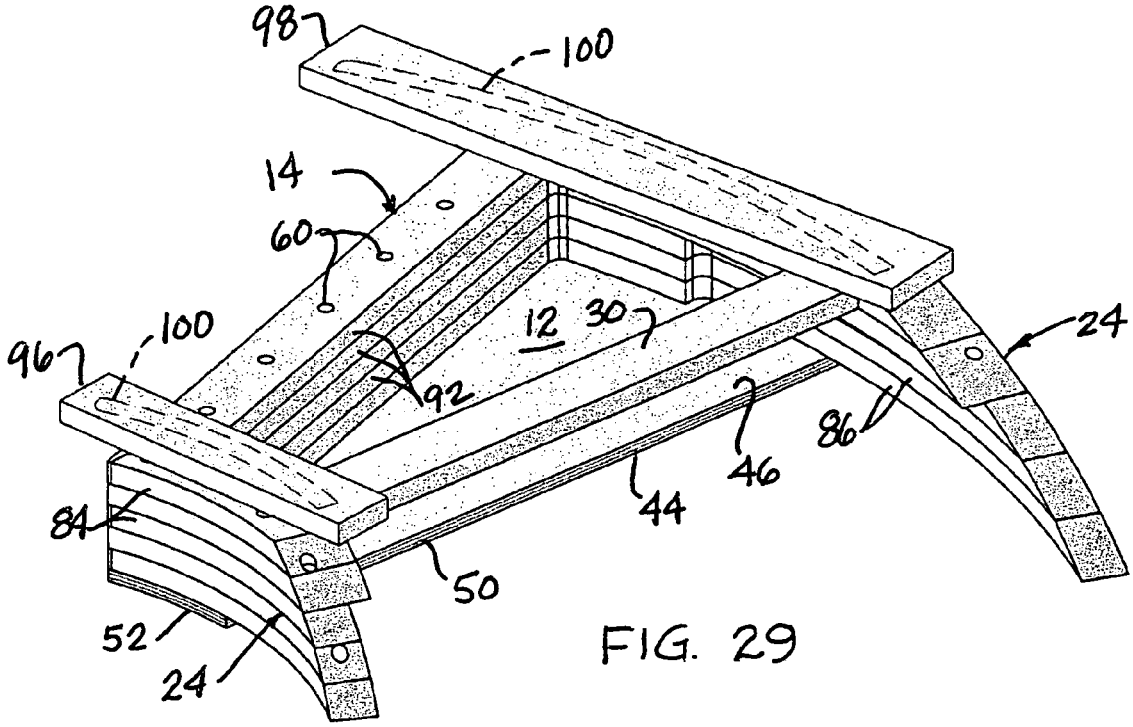
Figure 30:
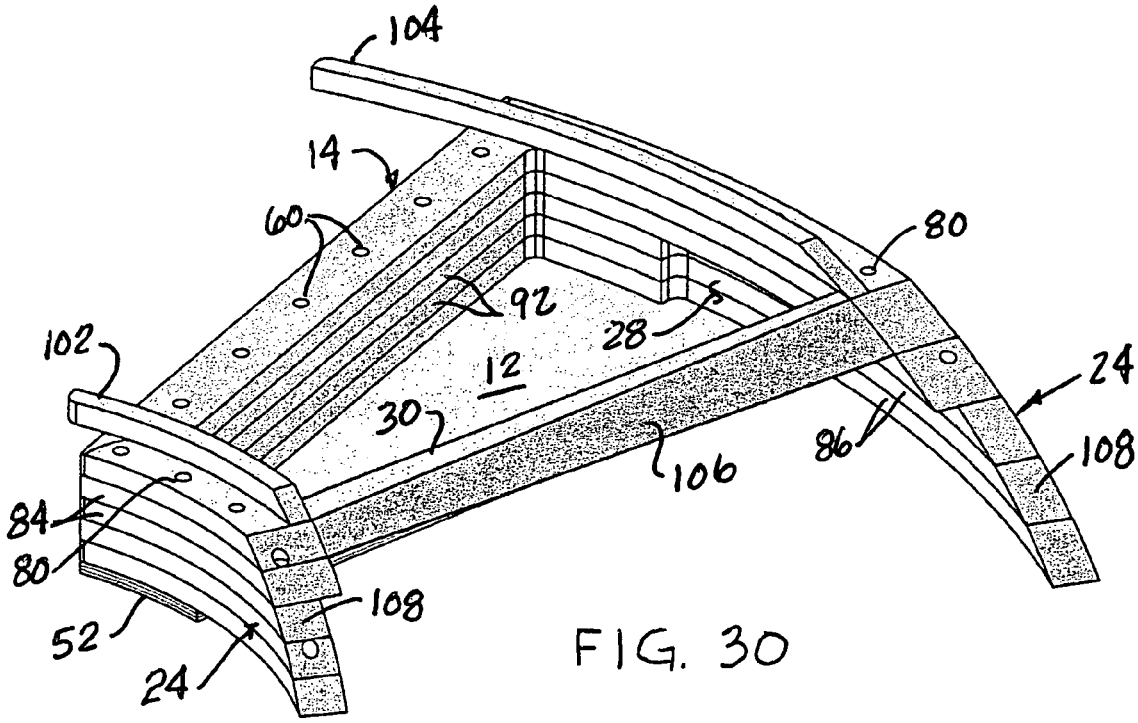
Figure 31:
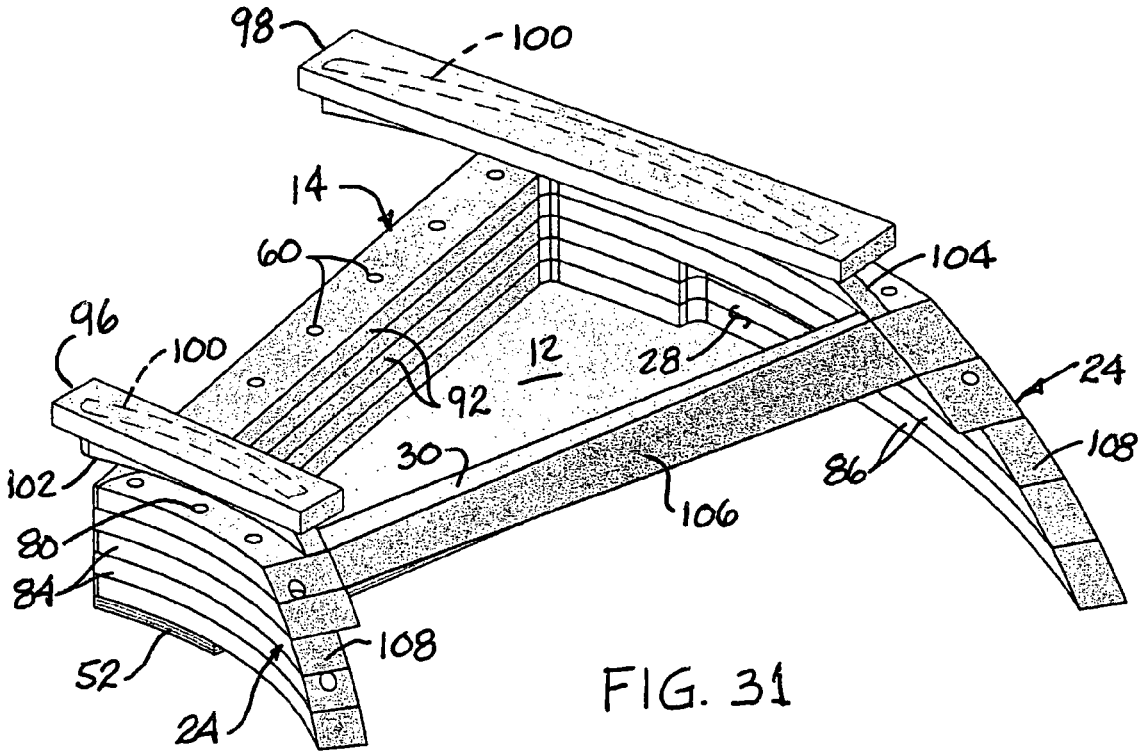
Figure 32:
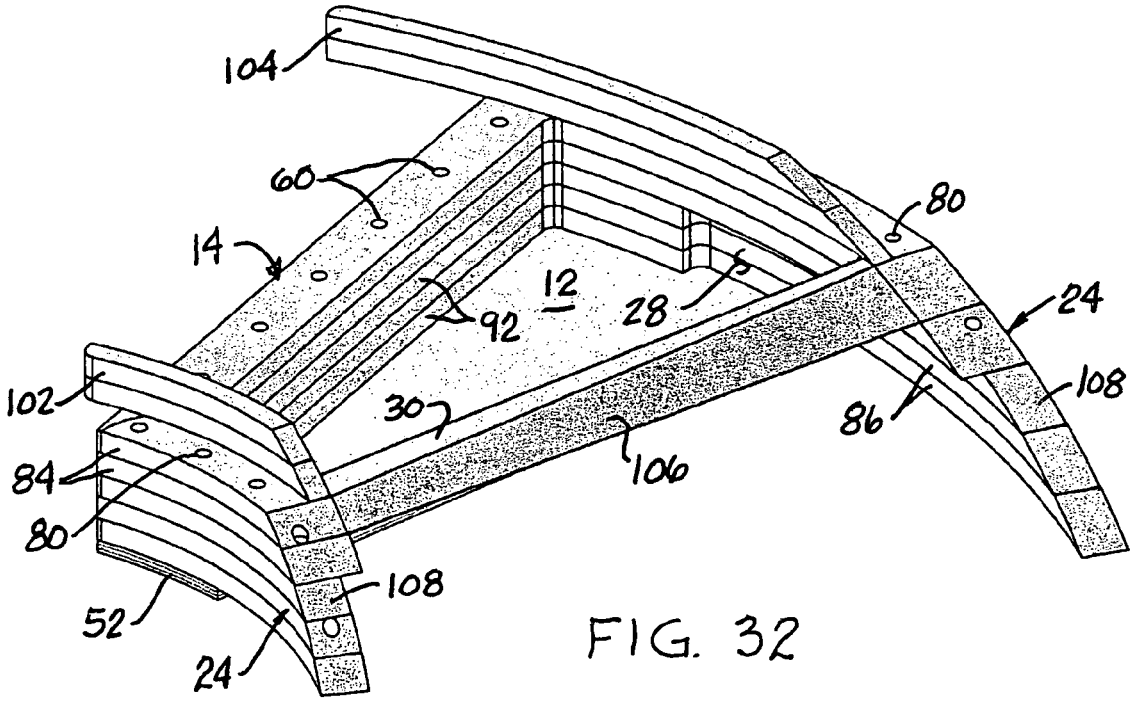
Figure 33:
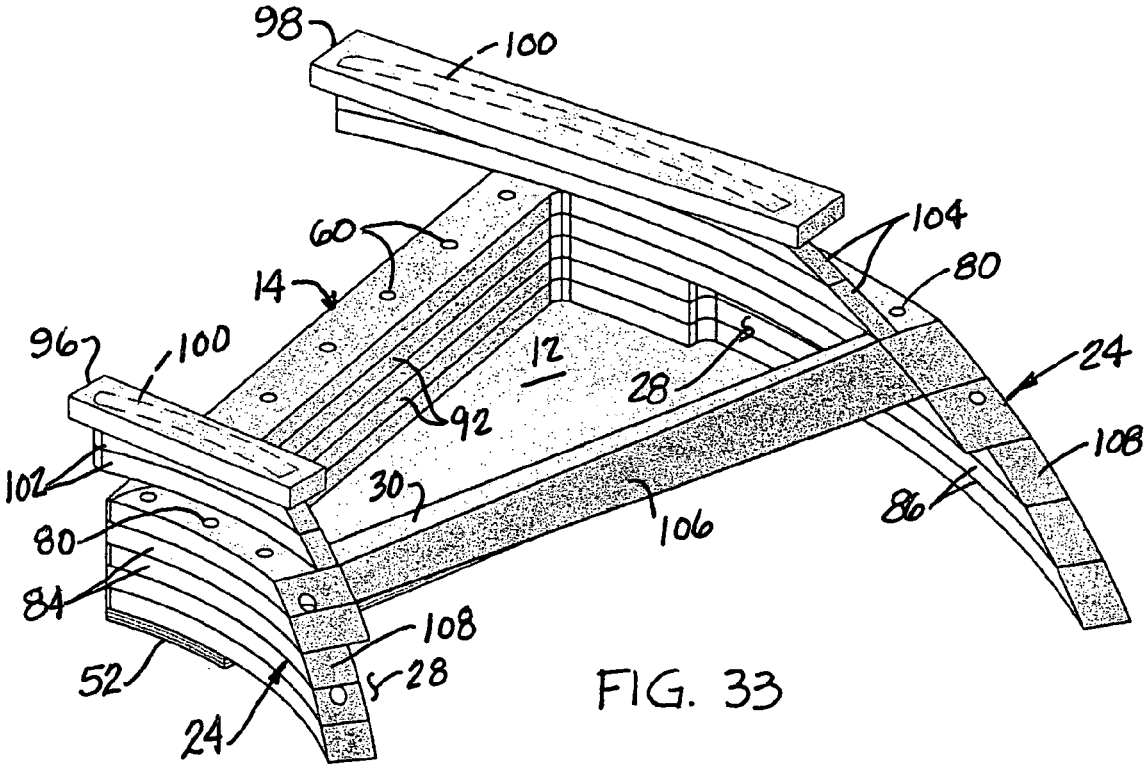

Referring initially to FIG. 29, elongated left and right rectangular solid wooden stringer blanks 96, 98 having trim line patterns 100 are respectively secured to the undersides of the lowermost stringer laminae 84, 86 in an orientation in which the blanks 96, 98 longitudinally project forwardly past the front side of the now completed riser 14. Then, as illustrated in FIG. 30, the stringer laminae 96, 98 are milled to their trim patterns 100 to form left and right stringer laminae 102 and 104 that are laterally inset from their overlying stringer laminae 84, 86. In conjunction with this milling step, the rectangularly cross-sectioned cross bracing member 30 is milled to a laterally twisted (or "swarfed") configuration in which, at its opposite ends, its rear side surface 106 is flush with the sloped rear end surfaces 108 of the rear stringer sections 24.

Figure 34:
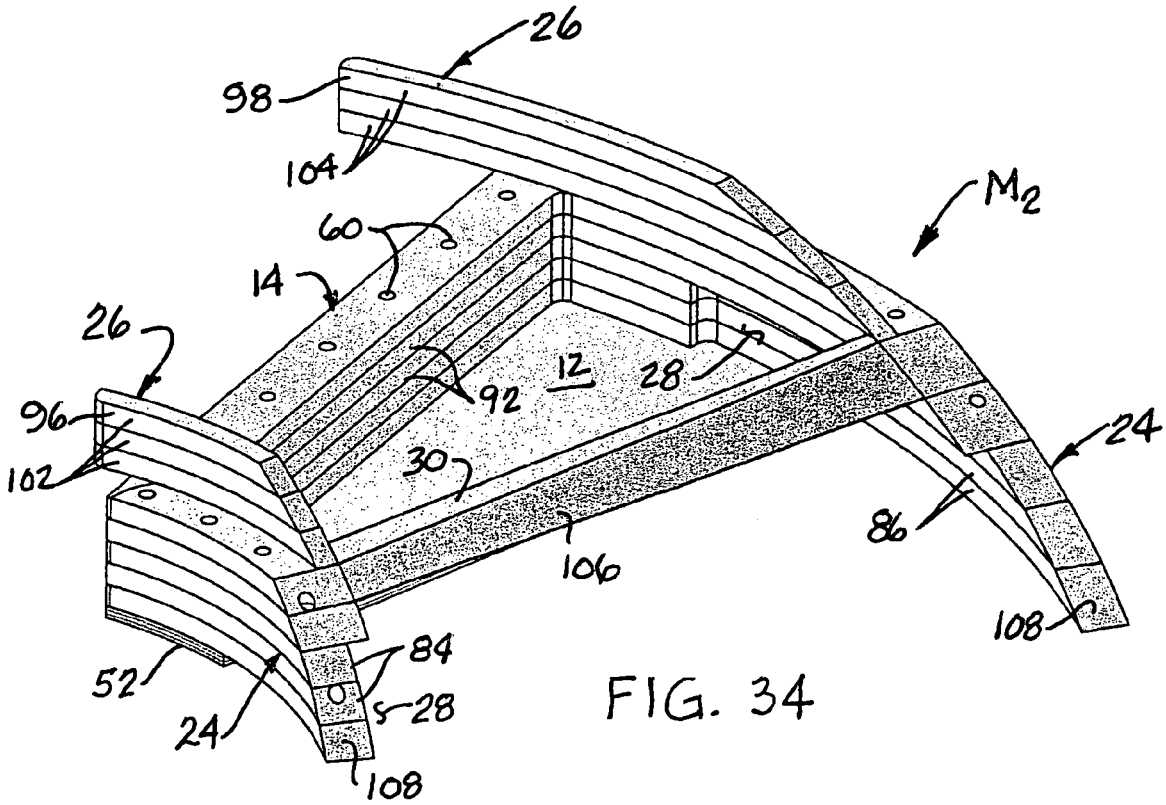

In a similar manner, as sequentially shown in FIGS. 31-34, two more stringer laminae 102, 104 are added to the undersides of these initial stringer laminae 102, 104 to form, as depicted in FIG. 34, the front stringer sections 26 of the now completed module $M_2$. The completed module $M_2$ may be removed from the underlying platen 34 (see FIG. 7) upon which it has been constructed in an upside down orientation, and used with the other modules to construct the staircase structure 10 as previously described. The lower end of the staircase may be secured to its associated floor (not shown) using bolts 109 (see FIG. 1) extended downwardly into the floor through the tread and riser portions 12, 14 of the lowermost module $M_1$. The upper end of the staircase (not shown) may be secured to its associated floor or landing structure using suitable fastening or attachment structures.

Figure 35:
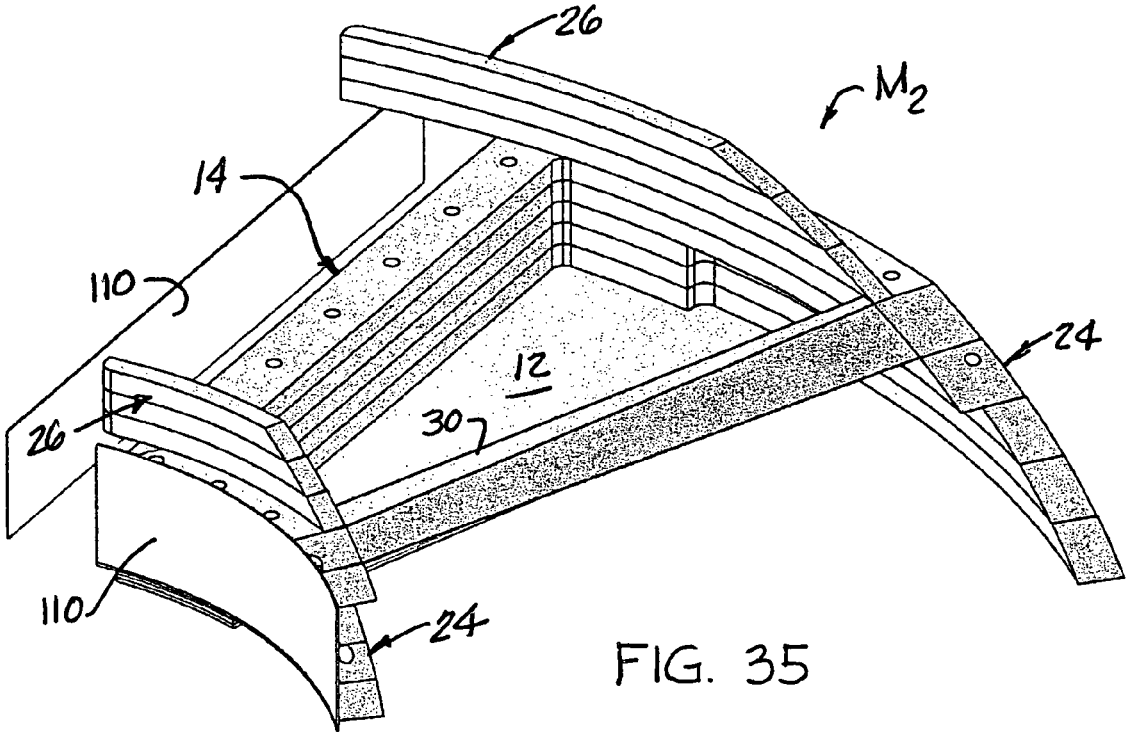
Figure 36:
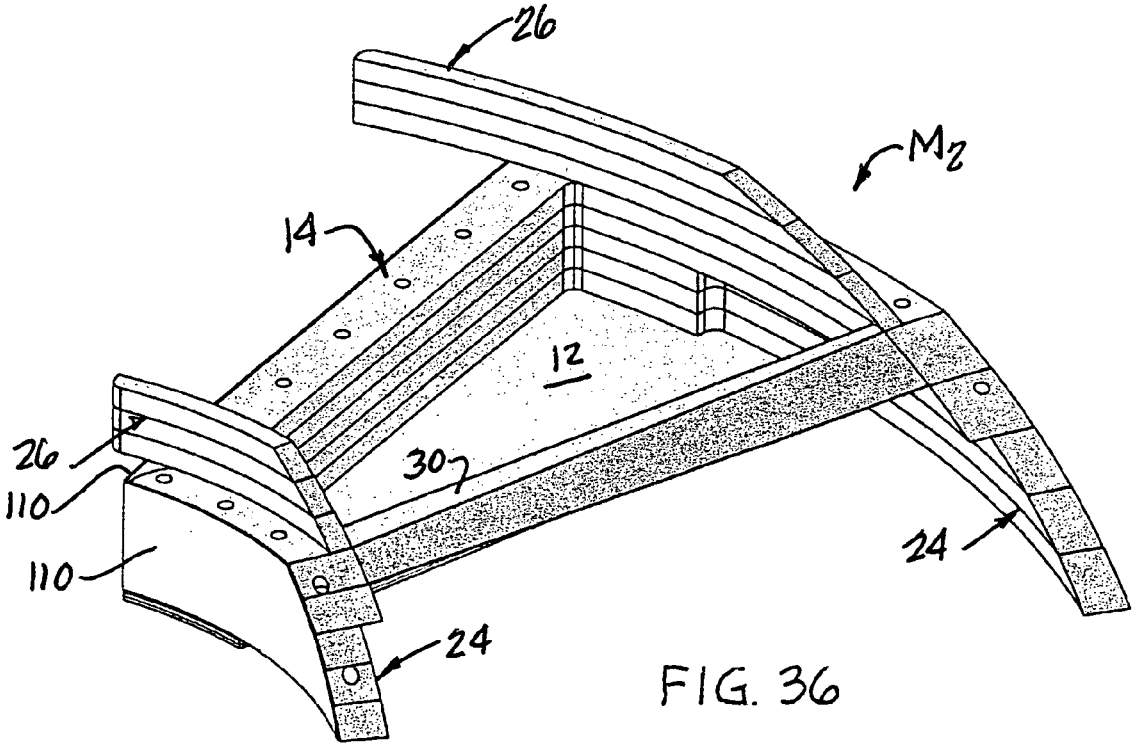
Figure 37:
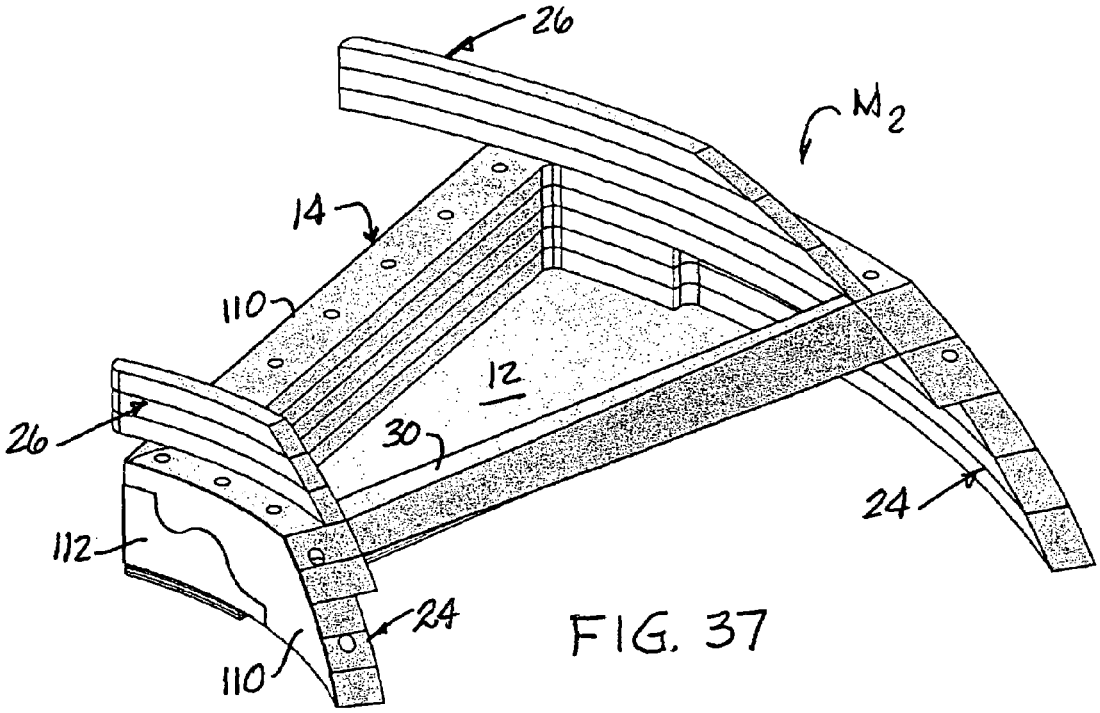

As previously described, the staircase structure 10 depicted in FIG. 1 is fabricated on-site by simply interlocking and intersecuring its longitudinal modules $M_1$-$M_{13}$. The completed longitudinal staircase modules may be used "as is" off the platen 34, or may have various finishes applied thereto (such as paint or stain) before or after being incorporated in the finished staircase. Alternatively, they may have applied thereto other finishing structures such as, for example, the veneer strips 110 applied to the outer sides of the stringer sections 24 as shown in FIGS. 35-37 together with decorative escutcheon structures 112 applied to the stringer veneers.

Figure 38:
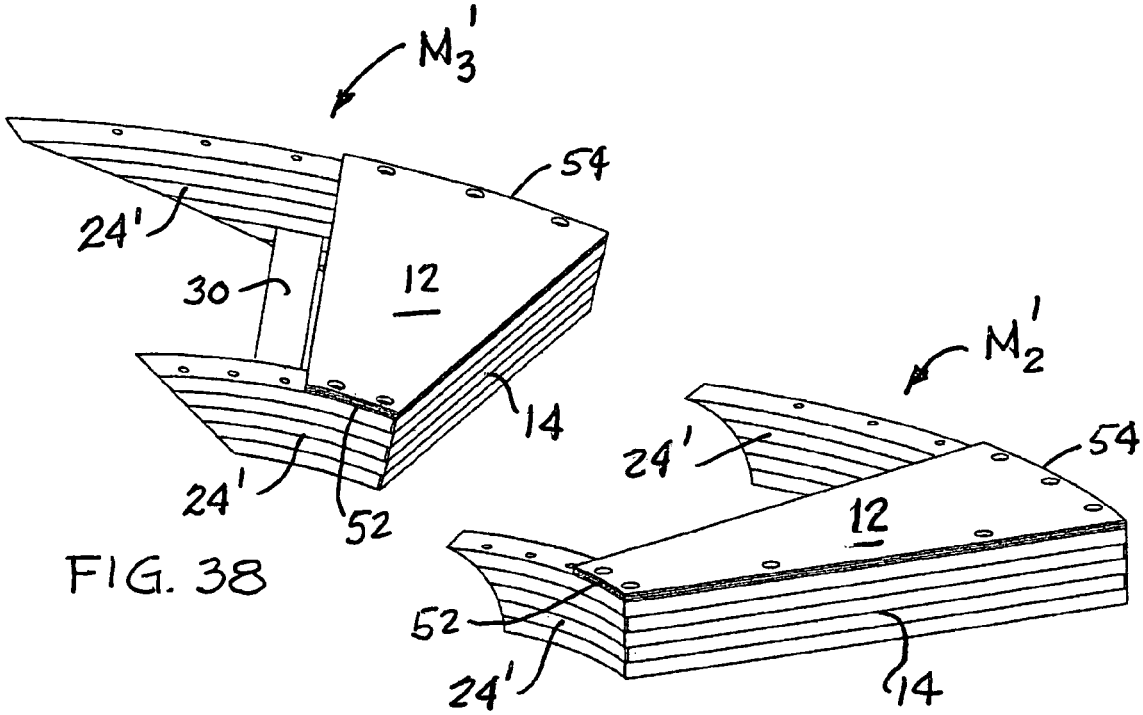
FIG. 38 is a top side perspective view of a pair of alternate embodiments of the longitudinal staircase modules prior to operative interfitting thereof.
Figure 39:
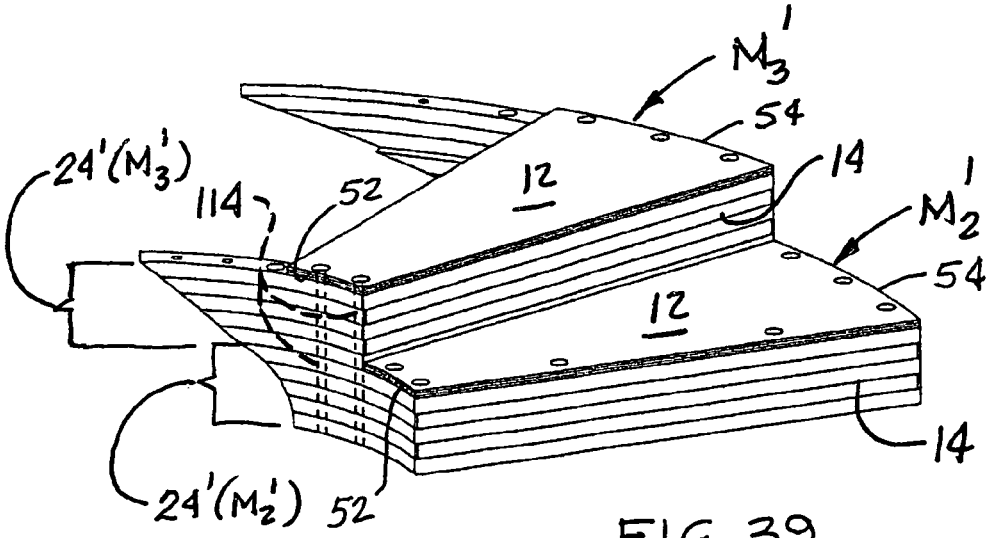
FIG. 39 is a top side perspective view of a the FIG. 38 staircase modules in their assembled state.

In the embodiment of the staircase structure 10 described in conjunction with FIGS. 1-6, the stringer portions of longitudinally adjacent pairs of the representatively illustrated staircase modules $M_1$-$M_{13}$ are overlapped in longitudinally telescoped interlocked and intersecured manners. An alternate method of intersecuring each longitudinally adjacent pair of staircase modules is depicted in FIGS. 38 and 39 in which modified versions $M_2'$ and $M_3'$ of modules $M_2$ and $M_3$ are representatively shown for illustrative purposes. In the modified modules $M_2'$ and $M_3'$ shown in FIGS. 38 and 39, their stringer portions do not have the previously described forwardly projecting sections 26, and their rear stringer sections 24' are not provided with the previously described laterally inner side surface recesses 28.

To operatively intersecure the modules $M_2'$ and $M_3'$ the rear stringer sections 24' of module $M_3'$ are longitudinally overlapped with and placed on top of the rear stringer sections 24' of module $M_2'$, and intersecured therewith by means of bolts 114 sequentially extended downwardly through left and right edge portions 52, 54 of the riser 12 of module $M_3$, the rear stringer section 24' of module $M_3$, and the underlying rear stringer section 24' of module $M_2'$. Of course, the other longitudinally adjacent module pairs in the staircase structure could also be intersecured in this manner if desired.

Figure 41:
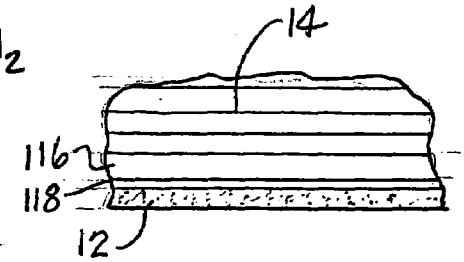
FIG. 41 is a schematic front side elevational view of a tread and riser portion of the assembled staircase of FIG. 1 illustrating the representative connection to the riser portion of a finished tread plate and underlying shim plate.

FIG. 41 is a front elevational view of a portion of one of the treads 12 of the staircase structure 12, and a portion of the rearwardly adjacent riser 14 of the upwardly adjacent staircase module. Each tread 12 may be used in its originally assembled form in the resulting staircase. However, if desired, a "finished" tread member 116 may be secured atop the tread 12 to improve the appearance of the finished staircase. A shim plate 118 may be interposed between the tread members 12 and 116 to adjust the elevation of the top side of the tread member 116. In this manner, deviations in the expected distance between floors which the completed staircase must vertically span can be adjusted for at the tread level without altering the balance of the staircase.

As can be readily seen from the foregoing, the modular characteristic of the staircase structure 10 permits it to be easily and quickly, and thus inexpensively, fabricated at the job site. Because of the high degree of precision built into its individual modules due to their in situ fabrication technique, little skill is necessary to correctly and accurately put the staircase structure together.

Additionally, due to the use of the laminated structure for each module, and forming such structure on a precision milling machine, each module is substantially entirely built "by the machine" as opposed to being built bit by bit and then hand fitted together. This adds to the dimensional preciseness of each module.

In the finished staircase structure 10 it can be seen that the stringer laminations in each module are vertically stacked (i.e., stacked in a direction perpendicular to the top side surfaces of the treads ) as opposed to being horizontally stacked as would be the case if the staircase structure had been constructed using conventional off-site or on-site construction techniques. This substantially strengthens the stringer laminae joints, thereby strengthening the overall staircase structure.

While a laminated wood construction has been illustrated and described herein for the longitudinal staircase modules, it will be readily be appreciated by those of skill in the staircase construction art that other materials and nonlaminated construction methods could be alternatively be utilized, if desired, without departing from principles of the present invention.

The described module construction method is preferably carried out using a 5-axis CNC milling machine. This in situ formation method, however, could also be employed using a 3-axis CNC milling machine, but if a 3-axis milling machine were to be used the module construction method would require some additional hand work to achieve the desired configurational precision and smoothness.

While it is preferred to use an in situ method of fabricating the modules, an alternate technique, using simpler machine programming could be utilized, without departing from principles of the present invention, using a 3-axis milling machine in which the individual laminae were formed in flat sheet stock, removed from the flat sheet and then assembled and suitable intersecured to form the ready-to-assemble modules.

As may be seen in FIG. 1, the opposite bottom side edges of the completed curved staircase curve about a vertical axis. However, if the opposite sides of the staircase were to be straightened their bottom edges would lie in essentially straight, upwardly sloping lines. The described method of constructing the staircase could also be utilized to construct a staircase in which these bottom side edge portions are upwardly arched along their lengths without departing from principles of the present invention. This arched bottom side edge configuration would give the completed staircase a higher vertical load capability, and less "vertical bounce", due to he load-created increase in compression in the stair structure as opposed to an increase in tension where a non-arched bottom edge configuration is provided.

The foregoing detailed description is to be clearly understood as being given by way of illustration and example only, the spirit and scope of the present invention being limited solely by the appended claims.

What is claimed is:

1. A method of constructing a staircase structure comprising the steps of:

providing a series of pre-assembled staircase modules each having a tread portion, a riser portion extending substantially perpendicular thereto, and a longitudinally outwardly projecting stringer portion separate from the stringer portions of the rest of the pre-assembled staircase modules;

positioning said staircase modules in a longitudinally serial array in which the stringer portion of each module engages and longitudinally overlaps the stringer portion of each longitudinally adjacent module in a manner such that the separate stringer portions of the pre-assembled staircase modules collectively define stringer structures extending along opposite sides of the overall length of the constructed staircase structure; and intersecuring each longitudinally adjacent pair of the positioned staircase modules;

each tread portion has a top surface; and said providing step includes the step of providing each strincier portion with a laminated configiuration defined by stringer laminae stacked in a direction perpendicular to the top surface of the associated tread portion.

2. A staircase structure constructed by the method of claim 1.

3. The method of claim 1 wherein:

said intersecuring step is performed by intersecuring each engaged, longitudinally overlapping pair of stringer portions of the pre-assembled staircase modules.

4. A staircase structure constructed by the method of claim 3.

5. The method of claim 3 wherein:

said positioning step is performed in a manner such that the stringer portion of each module is in an interfitted relationship with the stringer portion of each longitudinally adjacent module, and said intersecuring step is performed by securing each stringer portion to the stringer portion with which it is in an interfitted relationship.

6. A staircase structure constructed by the method of claim 5.

7. The method of claim 3 wherein:

said positioning step is performed in a manner such that the stringer portion of each module overlies the stringer portion of the downwardly adjacent module without being in an interfitted relationship therewith.

8. A staircase structure constructed by the method of claim 7.

9. The method of claim 1 wherein:

said positioning step is performed in a manner such that, with the exception of the lowermost module, the stringer portion of each module underlies and upwardly abuts the tread portion of the downwardly adjacent module.

10. A staircase structure constructed by the method of claim 9.

11. The method of claim 1 wherein:

the constructed staircase is at least partially curved in a lateral direction along its length, and said providing step includes the step of providing the stringer portion of at least one module with a laterally curved configuration.

12. A staircase structure constructed by the method of claim 11.

13. The method of claim 1 wherein:

each tread portion has a top surface; and said providing step includes the step of providing each riser portion with a laminated configuration defined by laminae stacked in a direction perpendicular to the top surface of the associated tread portion.

14. A staircase structure constructed by the method of claim 13.

15. A method of constructing a pre-assembled staircase module connectable in series with similar pre-assembled staircase modules to define a longitudinal portion of an overall staircase structure, said method comprising the steps of:

providing a tread structure having top and bottom surfaces, front and rear edge portions, and laterally opposite left and right side edge portions;

securing a downwardly projecting transverse riser structure to said front edge portion of said tread structure; and connecting elongated stringer structures to the bottom side of said tread structure in a manner such that the stringer structures longitudinally extend along and parallel to said laterally opposite left and right side edge portions of said tread structure and longitudinally project beyond said tread structure, said stringer structures being configured to engage, longitudinally overlap and be secured to the stringer structures of at least one longitudinally adjacent one of the similar pre-assembled staircase modules so as to collectively define therewith a longitudinal section of the stringer structure of the longitudinal portion of the overall staircase structure;

said connecting step is performed by connecting elongated laminated stringer structures to the bottom surfaces of said tread structure in a manner such that the secured laminated striger structures longitudinally extend along and parallel to said laterally opposite left and right side edge portions of said tread structure and longitudinally project outwardly from said tread structure, each of said laminated stringer structures being defined by stringer laminae stacked in a direction perpendicular to said top surface of said tread structure.

16. A pre-assembled staircase module constructed by the method of claim 15.

17. The method of claim 15 wherein:

said securing step is performed by securing a laminated riser structure to the bottom surface of said tread structure along said front edge portion thereof, said laminated riser structure being defined by riser laminae stacked in a direction perpendicular to said top surface of said tread structure.

18. The method of claim 17 wherein:

said securing step includes the step of forming said riser laminae in situ on said bottom side of said tread structure, and said connecting step includes the step of forming said stringer laminae in situ on said bottom side of said tread structure.

19. The method of claim 18 wherein:

said step of forming said riser laminae in situ is performed by securing riser laminae blanks to said bottom side of said tread structure and milling said riser laminae blanks to final sizes to form said riser laminae, and said step of forming said stringer laminae in situ on said bottom side of said tread structure is performed by securing stringer laminae blanks to said bottom side of said tread structure and milling said stringer laminae blanks to final sizes to form said stringer laminae.

20. The method of claim 17 wherein:

said milling steps are performed using a CNC milling machine.

21. The method of claim 17 further comprising the steps of:

interdigitating left end portions of said riser laminae with front end portions of said stringer laminae in the left stack thereof, and interdigitating right end portions of said riser laminae with front end portions of said stringer laminae in the right stack thereof.

22. The method of claim 21 further comprising the steps of:

forming said riser and stringer laminae in manners such that, in alternating layers of said laminated riser and stringer structures, convex opposite end portions of a riser lamina complementarily engage concave end portions of stringer laminae, and concave opposite end portions of a riser lamina complementarily engage convex end portions of stringer laminae.

23. The method of claim 15 further comprising the step of:

configuring a lower section of each stringer structure disposed below said riser structure to project forwardly past said riser structure.

24. The method of claim 15 further comprising the step of:

configuring a longitudinal section of each stringer structure to project rearwardly past said tread structure and have a groove extending longitudinally inwardly from a rear end surface of the longitudinal section of the stringer structure.

25. The method of claim 15 further comprising the step of:

configuring a longitudinal section of each stringer structure to project rearwardly past said tread structure, and connecting opposite ends of an elongated cross-bracing member to said longitudinal stringer structure sections.

26. The method of claim 25 further comprising the step of:

milling the connected cross-bracing member to a laterally twisted configuration.

27. The method of claim 26 wherein:

said milling step is performed using a CNC milling machine.

28. A method of constructing a pre-assembled staircase module connectable in series with similar pre-assembled staircase modules to define a longitudinal portion of an overall staircase structure, said method comprising the steps of:

providing a tread structure having top and bottom surfaces and front and rear edge portions;

securing a downwardly projecting transverse riser structure to said tread structure; and connecting an elongated stringer portion to said tread structure in a manner such that said stringer portion longitudinally extends beneath and longitudinally beyond said tread structure, said stringer portion being configured to engage, longitudinally overlap and be secured to the stringer portion of at least one longitudinally adjacent one of the pre-assembled staircase modules so as to collectively define therewith a longitudinal section of the stringer structure of the longitudinal portion of the overall staircase structure said providing step includes the step of providing each stringer portion with a laminated configuration defined by stringer laminae stacked in a direction perpendicular to the top surface of the associated tread portion.

29. A pre-assembled staircase module constructed by the method of claim 28.

* * * * *